US008307512B2

(12) United States Patent
Osaki

(10) Patent No.: US 8,307,512 B2
(45) Date of Patent: Nov. 13, 2012

(54) HINGE APPARATUS AND ATTACHMENT MEMBER FOR THE SAME

(75) Inventor: Masahiro Osaki, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 228 days.

(21) Appl. No.: 12/755,173

(22) Filed: Apr. 6, 2010

(65) Prior Publication Data

US 2010/0257700 A1 Oct. 14, 2010

(30) Foreign Application Priority Data

Apr. 8, 2009 (JP) ..... 2009-094314

(51) Int. Cl.
*E05D 3/06* (2006.01)

(52) U.S. Cl. ..... 16/368; 16/366

(58) Field of Classification Search ..... 16/365–370, 16/374, 236–238, 286, 387; 296/146.11, 296/146.12
See application file for complete search history.

(56) References Cited

U.S. PATENT DOCUMENTS

| | | | | |
|---|---|---|---|---|
| 2,008,256 | A * | 7/1935 | Lefevre | 16/370 |
| 3,611,474 | A * | 10/1971 | Meyer | 16/358 |
| 4,716,623 | A * | 1/1988 | Kinaga et al. | 16/371 |
| 4,854,010 | A * | 8/1989 | Maraghe et al. | 16/360 |
| 5,685,046 | A * | 11/1997 | Neag et al. | 16/366 |
| 6,647,592 | B2 * | 11/2003 | Presley | 16/366 |
| 6,817,065 | B1 * | 11/2004 | Bruckner | 16/366 |
| 6,834,834 | B2 * | 12/2004 | Dazet et al. | 244/129.5 |
| 7,950,109 | B2 * | 5/2011 | Elliott et al. | 16/366 |
| 2008/0222844 | A1 * | 9/2008 | Broadhead et al. | 16/231 |
| 2009/0056078 | A1 * | 3/2009 | Njaastad | 16/366 |
| 2009/0106940 | A1 * | 4/2009 | Greenbank | 16/367 |

FOREIGN PATENT DOCUMENTS

| | | | |
|---|---|---|---|
| JP | 61-110618 | A | 5/1986 |
| JP | 03-15972 | U | 2/1991 |
| JP | 2004-225451 | A | 8/2004 |
| JP | 2007-177427 | A | 7/2007 |

OTHER PUBLICATIONS

Mechanical English translation of Japanese Patent Application 2004-225451, filed Jan. 27, 2003 (15 pages).
Office Action in Japanese Patent Application No. 2009-094314, dated Feb. 22, 2011 and English translation thereof, 6 pages.
Patent Abstracts of Japan, Publication No. 2007-177427, Publication Date Jul. 12, 2007, 1 page.
Patent Abstracts of Japan, Publication No. 61-110618, Publication Date May 28, 1986, 1 page.

* cited by examiner

*Primary Examiner* — Chuck Y. Mah
(74) *Attorney, Agent, or Firm* — Osha Liang LLP

(57) ABSTRACT

One end portion and the other end portion of the first link 51 are respectively rotatably connected to a first housing side attachment member 11 and a second housing side attachment member 21. Upper and lower side portions of one end portion of the second link 61 are respectively rotatably connected to the first and second housing side attachment members 11, 21. Upper and under side portions of the other end portion of the second link 61 are respectively rotatably connected to the first and second door side attachment members 31, 41. One end portion and the other end portion of the third link 71 are respectively rotatably connected to the second housing side attachment member 21 and the second door side attachment member 41. The first, second and third links 51, 61, 71 are arranged to be spaced from one another in the direction of rotation axes thereof.

6 Claims, 19 Drawing Sheets

HINGE APPARATUS AND ATTACHMENT MEMBER FOR THE SAME

TECHNICAL FIELD

The present invention relates to a hinge apparatus for rotatably connecting a door to a housing such that the door maintains a constant attitude while being rotated and the present invention relates to an attachment member suitable to be used in the hinge apparatus.

BACKGROUND ART

As taught in the patent document 1 mentioned below, this type of hinge apparatus generally includes a housing side attachment member to be attached to a housing, a door side attachment member to be attached to a door, and first, second and third links. One end portions of the first, second and third links are connected to the housing side attachment member such that the first, second and third links are respectively rotatable about first, second and third rotation axes parallel to one another. The other end portions of the first, second and third links are connected to the door side attachment member such that the first, second and third links are respectively rotatable about fourth, fifth and sixth rotation axes parallel to the first, second and third rotation axes. By this arrangement, the door is attached to the housing via the hinge apparatus such that the door can be rotated between open and closed positions. Moreover, since the first, second and third links constitute a parallel link mechanism, the door maintains a constant attitude while being rotated. In other words, the door is moved in parallel.

PRIOR ART DOCUMENTS

Patent Documents

Patent Document 1: Japanese Patent Application Publication No. 2004-225451

SUMMARY OF INVENTION

Technical Problem

In the prior art hinge apparatus mentioned above, portions of at least two of the first, second and third links, for example the second and third links, are arranged in the same position in the direction of the first to the sixth rotation axes. In this arrangement, the first, second and third links may interfere with one another when rotation angles of the first, second and third links are large. Therefore, it was difficult to make the first, second and third links rotate over large angles. This raises a problem that a rotation angle of the door side attachment member with respect to the housing side attachment member, i.e., an open/close rotation angle (parallel translation distance) of the door, cannot be made large.

Solution to Problem

To solve the problem mentioned above, a first aspect of the present invention provides a hinge apparatus comprising: a housing side attachment member; a door side attachment member; first, second and third links, one end portions of the first, second and third links connected to the housing side attachment member such that the first, second and third links are respectively rotatable about first second and third rotation axes parallel to one another, the other end portions of the first, second and third links connected to the door side attachment member such that the first, second and third links are respectively rotatable about fourth, fifth and sixth rotation axes parallel to the first, second and third rotation axes; and a parallel link mechanism constituted by the housing side attachment member, the door side attachment member, and the first, second and third links, the first, second and third links being arranged in that order, spaced from one another in a direction of the rotation axes thereof.

In this case, it is preferable that the housing side attachment member has first and second housing side attachment members formed as separate components and arranged to be spaced from each other in the direction of the first, second and third rotation axes; the one end portion of the first link is connected to the first housing side attachment member such that the first link is rotatable about the first rotation axis; a one side portion of the one end portion of the second link in the direction of the rotation axis is connected to the first housing side attachment member such that the second link is rotatable about the second rotation axis; the other side portion of the one end portion of the second link in the direction of the rotation axis is connected to the second housing side attachment member such that the second link is rotatable about the second rotation axis; the one end portion of the third link is connected to the second housing side attachment member such that the third link is rotatable about the third rotation axis; the door side attachment member has first and second door side attachment members formed as separate components and arranged to be spaced from each other in the direction of the fourth, fifth and sixth rotation axes; the other end portion of the first link is connected to the first door side attachment member such that the first link is rotatable about the fourth rotation axis; a one side portion of the other end portion of the second link in the direction of the rotation axis is connected to the first door side attachment member such that the second link is rotatable about the fourth rotation axis; the other side portion of the other end portion of the second link in the direction of the rotation axis is connected to the second door side attachment member such that the second link is rotatable about the fifth rotation axis; and the other end portion of the third link is connected to the second door side attachment member such that the third link is rotatable about the sixth rotation axis.

It is preferable that the housing side attachment member has first and second housing side attachment members formed as separate components and arranged to be spaced from each other in the direction of the first, second and third rotation axes; the door side attachment member has first and second door side attachment members formed as separate components and arranged to be spaced from each other in the direction of the fourth, fifth and sixth rotation axes; the second link comprises two second links; one end portion of the first link and one end portion of one of the second links are connected to the first housing side attachment member such that the first link and the one of the second links are respectively rotatable about the first and second rotation axes; the other end portion of the first link and the other end portion of the one of the second links are connected to the first door side attachment member such that the first link and the one of the second links are respectively rotatable about the fourth and fifth rotation axes; one end portion of the other of the second links and one end portion of the third link are connected to the second housing side attachment member such that the other of the second links and the third link are respectively rotatable about the second and third rotation axes; and the other end portion of the other of the second links and the other end portion of the third link are connected to the second door side attachment member such that the other of the second links and the third link are respectively rotatable about the fifth and sixth rotation axes.

It is preferable that the housing side attachment member has first and second housing side attachment members formed as separate components and arranged to be spaced from each other in the direction of the first, second and third rotation axes; each of the first and second housing side attachment member is provided with first, second and third connecting parts that can be respectively connected to the one end portions of the first, second and third links such that the first, second and third links are respectively rotatable about the first, second and third rotation axes; one end portions of the first and second links are respectively connected to the first and second connecting parts of the first housing side attachment member such that the first and second links are respectively rotatable about the first and second rotation axes; one end portions of the second and third links are respectively connected to the second and third connecting parts of the second housing side attachment member such that the second and third links are respectively rotatable about the second and third rotation axes; the door side attachment member has first and second door side attachment members formed as separate components and arranged to be spaced from each other in the direction of the fourth, fifth and sixth rotation axes; each of the first and second door side attachment member is provided with fourth, fifth and sixth connecting parts that can be respectively connected to the other end portions of the first, second and third links such that the first, second and third links are respectively rotatable about the fourth, fifth and sixth rotation axes; the other end portions of the first and second links are respectively connected to the fourth and fifth connecting parts of the first door side attachment member such that the first and second links are respectively rotatable about the fourth and fifth rotation axes; and the other end portions of the second and third links are respectively connected to the fifth and sixth connecting parts of the second door side attachment member such that the second and third links are respectively rotatable about the fifth and sixth rotation axes.

A second aspect of the present invention specifies an attachment member suitable to be used in the hinge apparatus of the first aspect of the present invention. The second aspect provides an attachment member for hinge apparatus comprising: first and second support plate parts opposed to each other; a connecting plate part connecting one side portions of the first and second support plate parts; a first connecting part formed in one end portion of the first support plate part in a longer direction of the first support plate part; a second connecting part formed in one end portion of at least one of the first support plate part and the second support plate part in longer directions of the first and second support plate parts; and a third connecting part formed in the one end portion of the second support plate part in the longer direction of the second support plate part, the first connecting part, the second connecting part and the third connecting part being provided for connecting one end portions of first, second and third links to the one end portions of the first and second support plate parts such that the first, second and third links are respectively rotatable about first, second and third rotation axes extending parallel to one another in a direction in which the first and second support plate parts are opposed to each other.

In this case, it is preferable that the first and second connecting parts are arranged side by side in a longer direction of the first and second support plate parts; a projecting portion is formed in the one end portion of the second support plate part, the projecting portion projecting in a direction orthogonal to the longer direction of the second support plate part; and the third connecting part is formed in the projecting portion.

It is preferable that the first connecting part is a first connecting hole formed in the first support plate part and extending along the first rotation axis; the second connecting part is a second connecting hole formed in at least one of the first support plate part and the second plate part and extending along the second rotation axis; the third connecting part is a third connecting hole formed in the second support plate part and extending along the third rotation axis; the first link is connected to the first support plate part via a first connecting shaft inserted in the first connecting hole such that the first link is rotatable about the first rotation axis; the second link is connected to the at least one of the first support plate part and the second support plate part via a second connecting shaft inserted in the second connecting hole such that the second link is rotatable about the second rotation axis; and the third link is connected to the second support plate part via a third connecting shaft inserted in the third connecting hole such that the third link is rotatable about the third rotation axis.

It is preferable that the first, second and third connecting holes are formed through the first and second support plate parts.

Advantageous Effects of Invention

According to the present invention having the above-mentioned features, the first, second and third links do not interfere with one another when the door side attachment member is rotated with respect to the housing side attachment member since the first, second and third links are arranged to be spaced from one another in the direction of the first to the sixth rotation axes. Therefore, the door side attachment member can be rotated over a large angle with respect to the housing side attachment member. Accordingly, the open/close rotation angle of the door can be made large.

DESCRIPTION OF EMBODIMENTS

Figure 1:
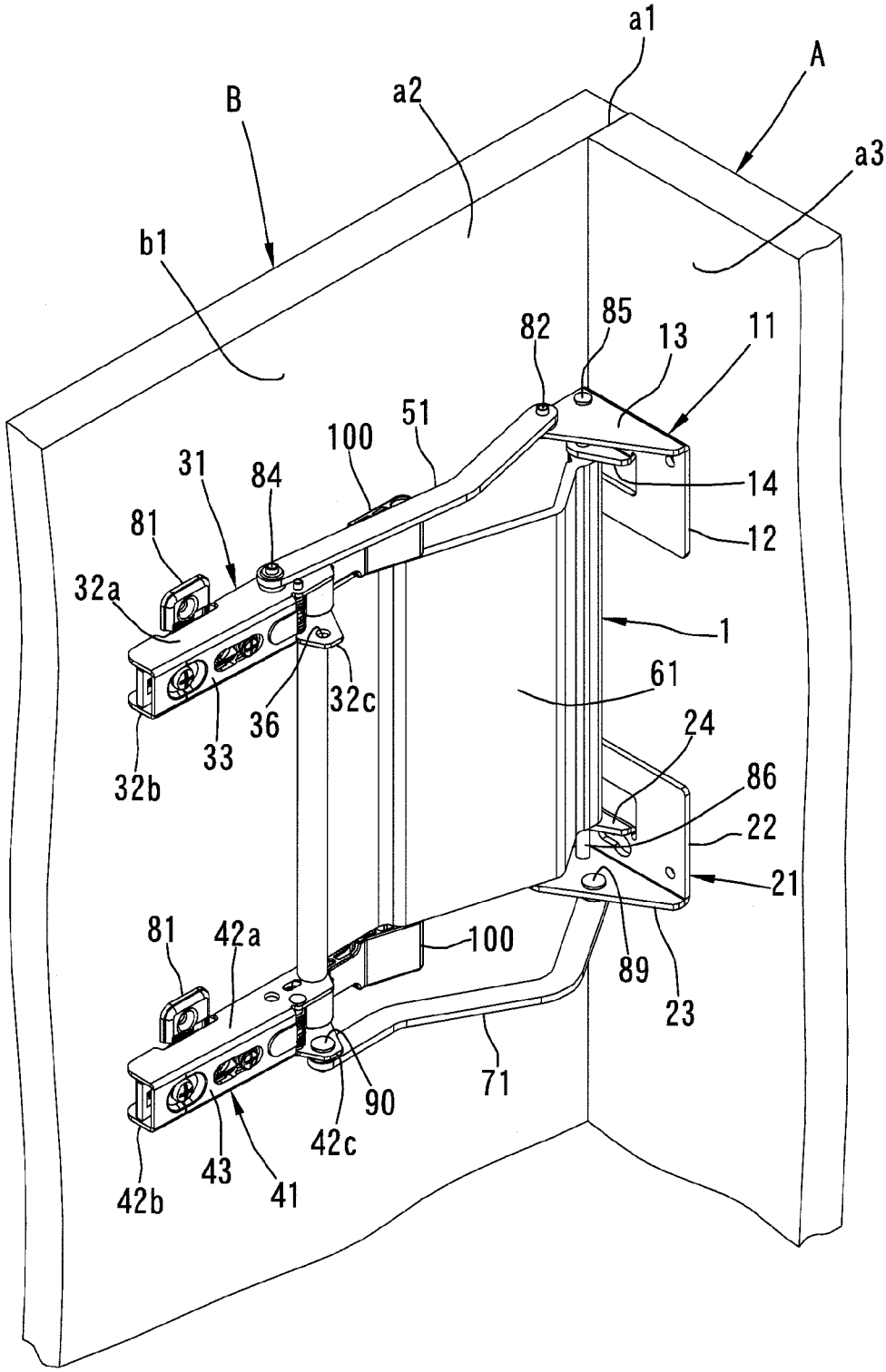
FIG. 1 is a perspective view of the first embodiment of the hinge apparatus according to the present invention with the hinge apparatus attached to the housing and the door.
Figure 2:
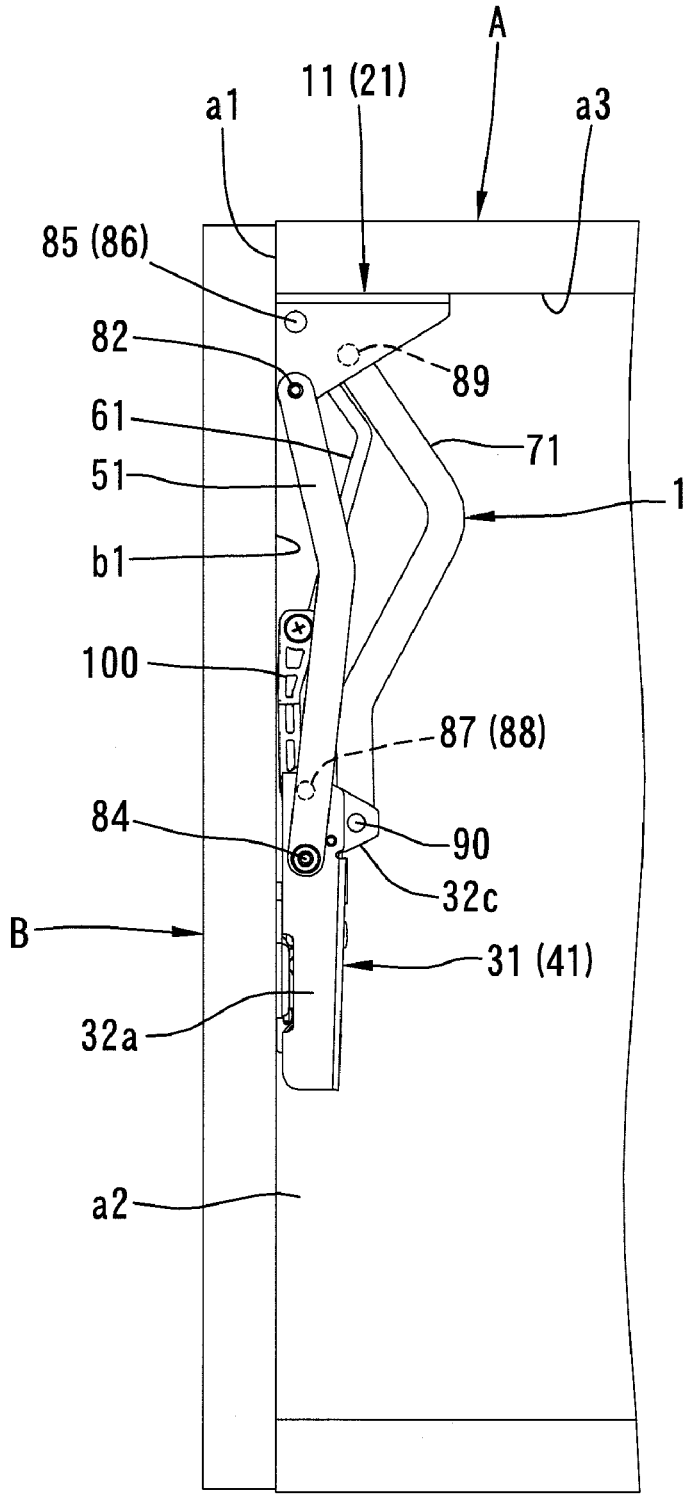
FIG. 2 is a plan view of the first embodiment with the door located in a closed position.
Figure 3:
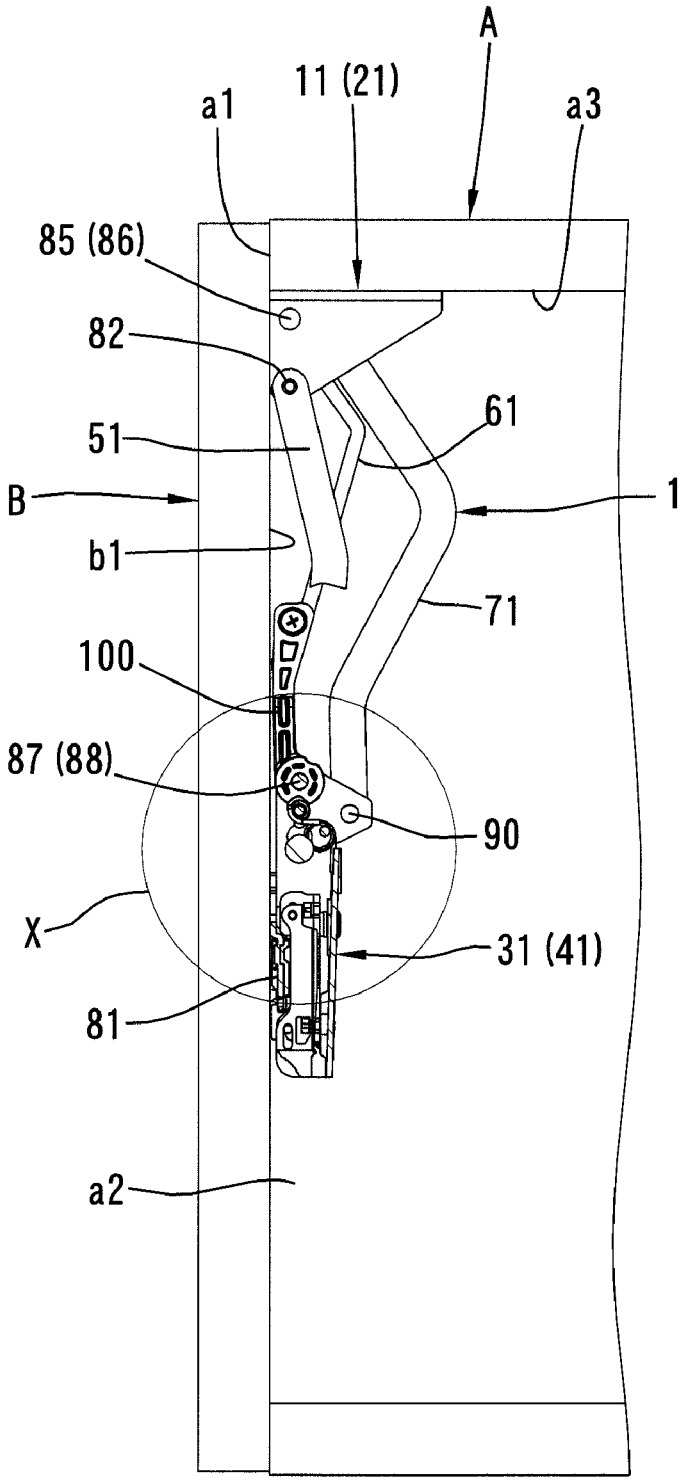
FIG. 3 is a partially cutaway plan view of the first embodiment with the door located in the closed position.
Figure 4:
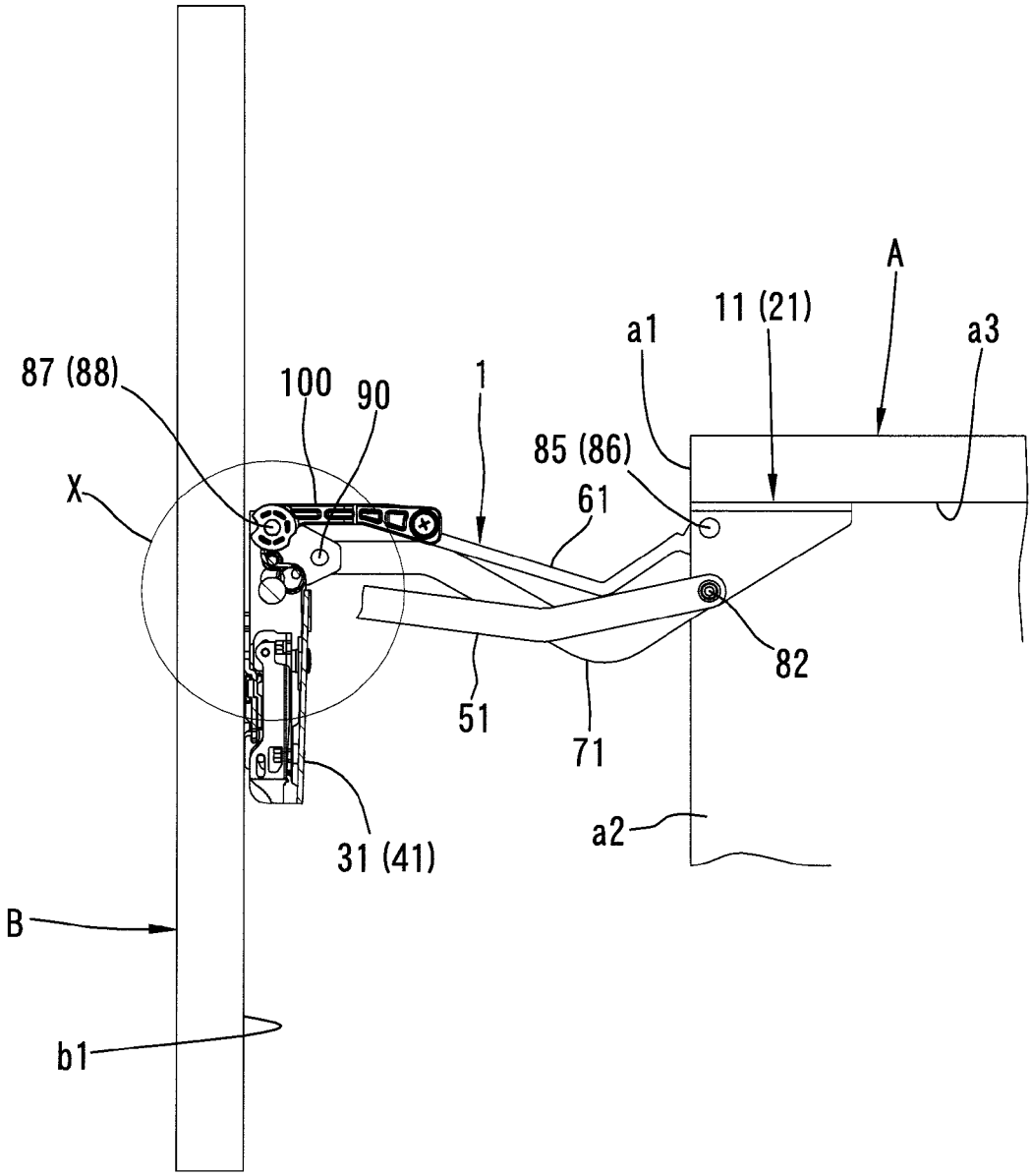
FIG. 4 is a partially cutaway plan view of the first embodiment with the door located in an intermediate position.
Figure 5:
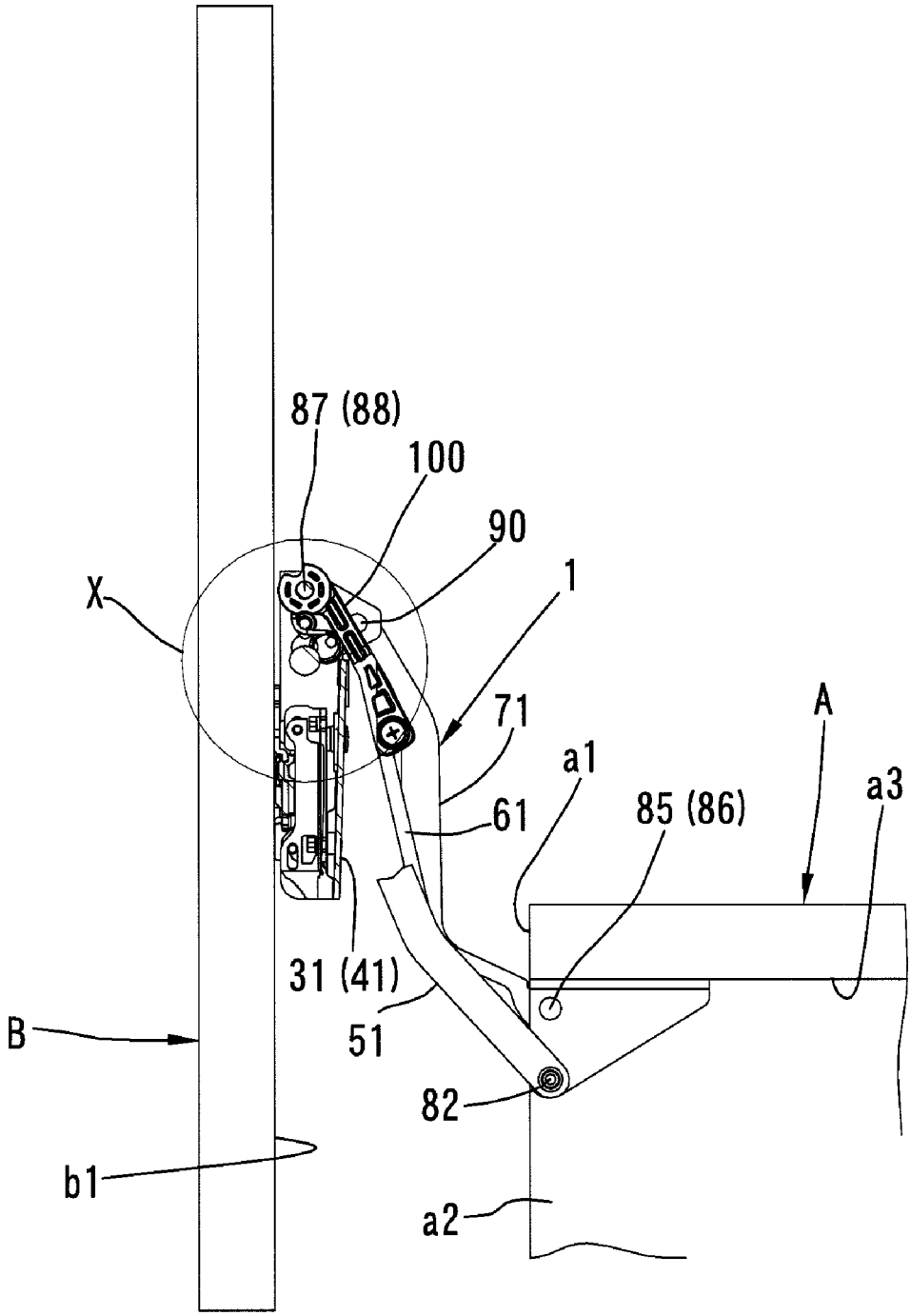
FIG. 5 is a partially cutaway plan view of the first embodiment with the door located in an open position.

A best mode for carrying out the present invention will be described hereinbelow with reference to drawings.

FIGS. 1 to 12 show a first embodiment of a hinge apparatus according to the present invention. A hinge apparatus 1 of the first embodiment is used in a container apparatus having a housing A and a door B. The housing A has a configuration of a rectangular parallelepiped box and has an opening a2 in a front surface a1 thereof. The door B is connected to a one side portion of the housing A via the hinge apparatus 1 such that the door B is capable of open-close rotation, and the door B can be rotated (practically the door B can be moved in parallel as described later) between a closed position shown in FIGS. 1 to 3 and an open position shown in FIG. 5.

The door B is positioned to the closed position by the abutment of a rear surface b1 thereof against the front surface a1 of the housing A. At the closed position and in the vicinity of the closed position, the door B is rotationally biased by the hinge apparatus 1 in a direction from the open position toward the closed position. The door B is forcibly rotated to the closed position and maintained in the closed position by the hinge apparatus 1. In the similar manner, at the open position and in the vicinity of the open position, the door B is rotationally biased by the hinge apparatus 1 in a direction from the closed position toward the open position. The door B is forcibly rotated to the open position and maintained in the open position by the hinge apparatus 1. Moreover, the door B is stopped at any position between the vicinity of the closed position and the vicinity of the open position by the hinge apparatus 1.

The hinge apparatus 1 that rotatably connects the door B to the housing A as mentioned above will now be described. As shown mainly in FIGS. 1 and 12, the hinge apparatus 1 includes a first housing side attachment member (housing side attachment member) 11, a second housing side attachment member (housing side attachment member) 21, a first door side attachment member (door side attachment member) 31, a second door side attachment member (door side attachment member) 41, a first link 51, a second link 61 and a third link 71.

The first housing side attachment member 11 is made of a rigid plate material such as metal. The housing side attachment member 11 has an attachment plate part 12 having a flat plate configuration and first and second erect plate parts 13, 14 erected at right angles from the attachment plate part 12 in the same direction. The attachment plate part 12 is fixed to an inner side surface a3 in a left wall part of the housing A. By this arrangement, the first housing side attachment member 11 is attached to the housing A. The first housing side attachment member 11 is arranged such that a front end of the first housing side attachment member 11 is generally on the same plane as the front surface a1 of the housing A. The first housing side attachment member 11 may be fixed to an inner side surface of a right wall part.

The first erect plate part 13 is integrally formed in an upper end portion of the attachment plate part 12 and is horizontally arranged. The second erect plate part 14 is integrally formed in the attachment plate part 12 and is horizontally arranged in the similar manner to the first erect plate part 13. However, the second erect plate part 14 is disposed in an intermediate portion of the attachment plate part 12 in a vertical direction, and is spaced downwardly from the first erect plate part 13 by a predetermined distance.

Figure 12:
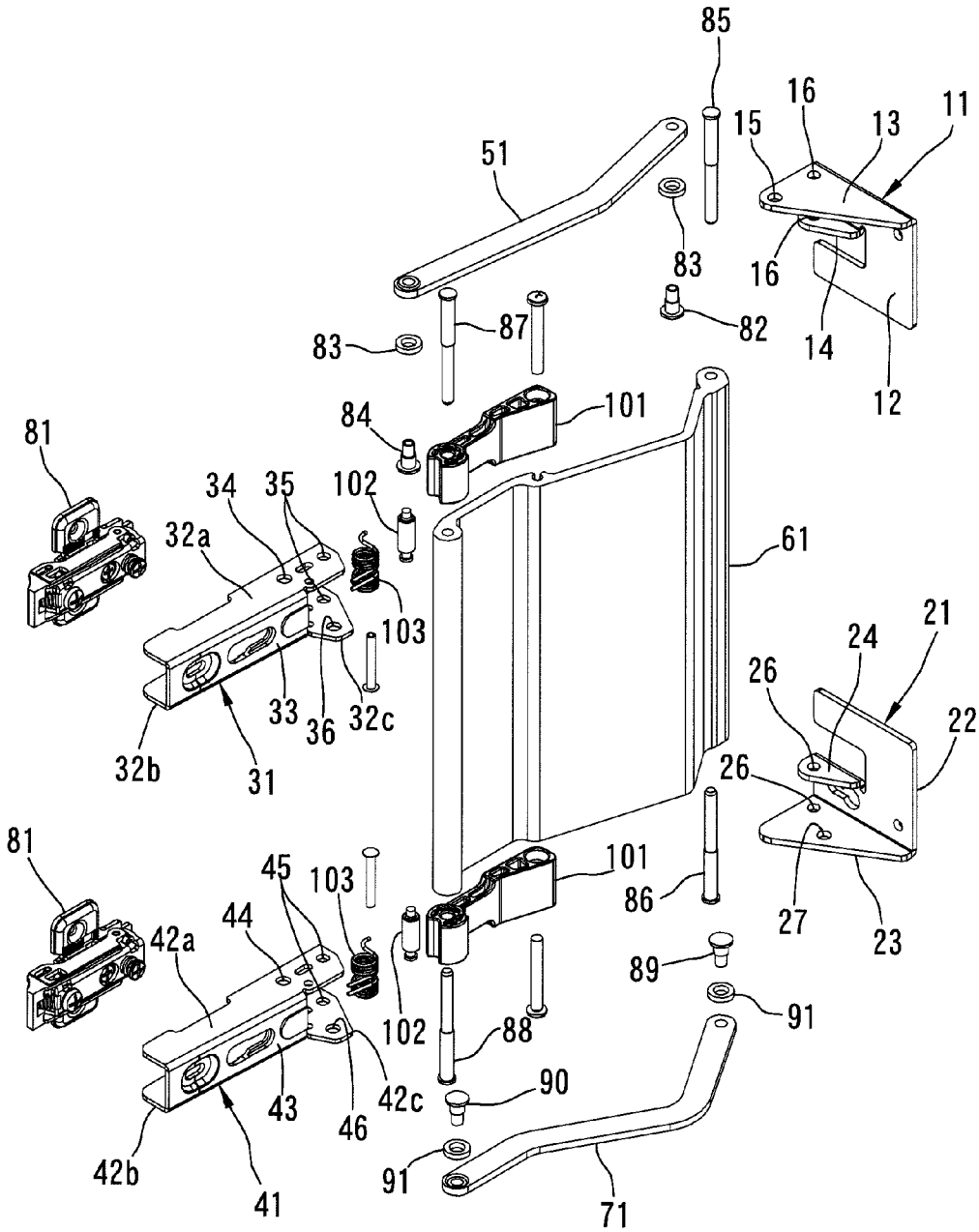
FIG. 12 is an exploded perspective view of the first embodiment

As shown in FIG. 12, the first erect plate part 13 has a first connecting hole (first connecting part) 15 formed vertically through the first erect plate part 13. The first connecting hole 15 is disposed in a distal end portion (end portion located nearer to the front surface a1 of the housing A) of the first erect plate part 13. The first and second erect plate parts 13, 14 have second connecting holes (second connecting parts) 16 formed vertically through the first and second erect plate parts 13, 14. The second connecting holes 16 are located generally in the same location as the first connecting hole 15 in a front-rear direction, but in a left-right direction, the second connecting holes 16 are located in locations spaced from the first connecting hole 15 to the right by a predetermined distance. In other words, the first and second connecting holes 15, 16 are arranged side by side in the left-right direction on a single straight line. The first and second connecting holes 15, 16 may be arranged to be spaced from each other in the front-rear direction.

The second housing side attachment member 21 is formed identically in a vertically symmetrical configuration to the first housing side attachment member 11 except that a third connecting hole (third connecting part) 27, in stead of the first connecting hole 15, is formed in the second housing side attachment member 21. Accordingly, the second housing side attachment member 21 has an attachment plate part 22, a first erect plate part 23, a second erect plate part 24 and a second connecting hole (second connecting part) 26, respectively corresponding to the attachment plate part 12, the first erect plate part 13, the second erect plate part 14 and the second connecting hole 16 of the first housing side attachment member 11. The second connecting hole 26 is arranged to be located in the same location as the second connecting hole 16 when viewed from an axial direction thereof (vertical direction). The third connecting hole 27 is formed in the first erect plate part 23 so as to vertically extend therethrough. The first connecting hole 15, the second connecting holes 16, 26, and the third connecting hole 27 are arranged to represent apexes of a triangle when viewed from the axial direction thereof (vertical direction). In this embodiment, they are particularly arranged to represent apexes of an equilateral triangle.

A base 81 is fixed to a generally central portion of the rear surface b1 of the door B in the left-right direction. The first door side attachment member (attachment member for hinge apparatus) 31 is removably attached to the base 81. The first door side attachment member 31 is formed generally to have a U-shape cross-section by first and second support plate parts 32*a*, 32*b* facing each other and a connecting plate part 33 connecting one side portions of the first and second support plate parts 32*a*, 32*b* in shorter directions. The first door side attachment member 31 is arranged such that a longer direction thereof is directed to a horizontal direction along the rear surface b1, the first and second support plate parts 32*a*, 32*b* are horizontally arranged, and an open portion of the first door side attachment member 31 is opposed to the base 81. The first door side attachment member 31 is attached to the base 81 such that the location of the first door side attachment member 31 can be adjusted in the vertical direction and in the horizontal direction along the rear surface b1. Moreover, the first door side attachment member 31 is attached to the base 81 such that a location of a distal end portion of the first door side attachment member 31, the distal end portion of the first door side attachment member 31 being an end portion located nearer the first housing side attachment member 11 when the door B is in the closed position, can be adjusted in a direction toward and away from the rear surface b1 (the front-rear direction of the housing A). By adjusting the location of the first door side attachment member 31, an upper surface of the first support plate part 32*a* of the first door side attachment member 31 is located on a same plane as an upper surface of the first erect plate part 13 of the first housing side attachment member 11 and an under surface of the second support plate part 32*b* of the first door side attachment member 31 is located on a same plane as an under surface of the second erect plate part 14.

As shown in FIG. 12, a fourth connecting hole (fourth connecting part, first connecting part) 34 is formed vertically through a distal end portion of the first support plate part 32*a* of the first door side attachment member 31 in the longer direction (one end portion located nearer the first housing side attachment member 11 when the door B is in the closed position). Fifth connecting holes (fifth connecting parts, second connecting parts) 35 are formed vertically through the distal end portions of the first and second support plate parts 32*a*, 32*b*. A projecting portion 32*c* projecting in a direction orthogonal to the longer direction of the second support plate part 32*b* (horizontal direction toward the housing A) is formed in the distal end portion of the second support plate part 32*b*. A sixth connecting hole (sixth connecting part, third connecting part) 36 is formed vertically through the projecting portion 32*c*. The fourth, fifth and sixth connecting holes 34, 35, are arranged to represent apexes of a triangle having the same configuration, the same dimensions and the same attitude as the triangle on which the first, second and third connecting holes 15, 16, 27 are arranged when viewed from an axial direction thereof (vertical direction). Therefore, the fourth and fifth connecting holes 34, 35 are arranged side by side on a straight line extending in the longer direction (left-right direction) of the first door side attachment member 31 and the sixth connecting hole 36 is arranged spaced from the fourth and fifth connecting holes 34, 35 in a direction orthogonal to the longer direction of the first door side attachment member 31.

The second door side attachment member (attachment member for hinge apparatus) 41 has the same configuration and the same dimensions as the first door side attachment member 31. Accordingly, the second door side attachment member 41 has a first support plate part 42*a*, a second support plate part 42*b*, a projecting portion 42*c*, a connecting plate part 43, a fourth connecting hole (fourth connecting part, first connecting part) 44, a fifth connecting hole (fifth connecting part, second connecting part) 45 and a sixth connecting hole (sixth connecting part, third connecting part) 46, respectively corresponding to the first support plate part 32*a*, the second support plate part 32*b*, the projecting portion 32*c*, the connecting plate part 33, the fourth connecting hole 34, the fifth connecting hole 35 and the sixth connecting hole 36. The second door side attachment member 41 is attached to the rear surface b1 of the door B via the base 81 in the same attitude as the first door side attachment member 31. Moreover, the second door side attachment member 41 is arranged to be spaced downwardly from the first door side attachment member 31 by a same distance as the distance between the first and second housing side attachment members 11, 21 in the vertical direction. As a result, an upper surface of the first support plate part 42*a* is located on a same plane as an upper surface of the second erect plate part 24 and an under surface of the second support plate part 42*b* is located on a same plane as an under surface of the first erect plate part 23. The fourth, fifth and sixth connecting holes 44, 45, 46 of the second door side attachment member 41 are arranged to be located at the same location as the fourth, fifth and sixth connecting holes 34, 35, 36 of the first door side attachment member 31 when viewed from an axial direction thereof. As a result, a distance between the axes of the first and fourth connecting holes 15, 34, a distance between the axes of the second and fifth connecting holes 16 (26), 35 and a distance between the axes of the third and sixth connecting holes 27, 36 are equal to one another.

The first door side attachment member 31 and the second door side attachment member 41 may be formed in different configurations and different dimensions as long as the fourth, fifth and sixth connecting holes 34, 35, 36 of the first door side attachment member 31 and the fourth, fifth and sixth connecting holes 44, 45, 46 of the second door side attachment member 41 are arranged to be located at the same location when viewed from the axial direction thereof.

The first link 51 is made of a rigid plate material such as metal, and is horizontally disposed above the first housing side attachment member 11 and the first door side attachment member 31. One end portion of the first link 51 is connected to the first housing side attachment member 11 such that the first link 51 is rotatable about an axis (first rotation axis) of a connecting shaft 82 inserted in the first connecting hole 15. Moreover, the one end portion of the first link 51 is rotatably contacted with an upper surface of the first erect plate part 23 via a washer 83. The other end portion of the first link 51 is connected to the first door side attachment member 31 such that the first link 51 is rotatable about an axis (fourth rotation axis, first rotation axis) of a connecting shaft (first connecting shaft) 84 inserted in the fourth connecting hole 34. The other end portion of the first link 51 is rotatably contacted with an upper surface of the first support plate part 32*a* of the first door side attachment member 31 via a washer 83.

The second link 61 is made of a rigid plate material such as metal. The second link 61 is disposed with a width direction of the second link 61 directed to the vertical direction. A one end portion of the second link 61 is located between the second erect plate part 14 of the first housing side attachment member 11 and the second erect plate part 24 of the second housing side attachment member 21 and the other end portion of the second link 61 is located between the second support plate part 32*b* of the first door side attachment member 31 and the first support plate part 42*a* of the second door side attachment member 41.

An upper side portion of the one end portion of the second link 61 is connected to a lower end portion of a connecting shaft 85 disposed through the second connecting holes 16 of the first and second erect plate parts 13, 14 of the first housing side attachment member 11. A lower side portion of the one end portion of the second link 61 is connected to an upper end portion of a connecting shaft 86 disposed through the second connecting holes 26 of the first and second erect plate parts 23, 24 of the second housing side attachment member 21. By this arrangement, the one end portion of the second link 61 is connected to the first and second housing side attachment members 11, 21 such that the second link 61 is rotatable about axis (second rotation axis) of the connecting shafts 85, 86.

An upper side portion of the other end portion of the second link 61 is connected to a lower end portion of a connecting shaft (second connecting shaft) 87 disposed through the fifth connecting hole 35 of the first door side attachment member 31. A lower side portion of the other end portion of the second link 61 is connected to an upper end portion of a connecting shaft (second connecting shaft) 88 disposed through the fifth connecting hole 45 of the second door side attachment member 41. By this arrangement, the other end of the second link 61 is connected to the first and second door side attachment members 31, 41 such that the second link 61 is rotatable about axes (fifth rotation axis, second rotation axis) of the connecting shafts 87, 88.

An upper side surface and an under side surface of the second link 61 are made as flat surfaces, and are horizontally disposed. One end portion and the other end portion of the upper side surface of the second link 61 are respectively contacted with the under surface of the second erect plate part 14 of the first housing side attachment member 11 and an under surface of the second support plate part 32*b* of the first door side attachment member 31 in a slidable (rotatable) manner. Accordingly, the second link 61 is located below and spaced from the first link 51 by a distance equal to a distance between the upper surface of the first erect plate part 13 and the under surface of the second erect plate part 14 (=distance between the upper surface of the first support plate part 32*a* and the under surface of the second support plate part 32*b*) plus a thickness of the washer 83. One end portion and the other end portion of the lower side surface of the second link 61 are respectively contacted with the upper surface of the second erect plate part 24 of the second housing side attachment member 21 and an upper surface of the first support plate part 42*a* of the second door side attachment member 41 in a slidable (rotatable) manner.

The third link 71 is made of a rigid plate material such as metal, and is horizontally disposed below the second housing side attachment member 21 and the second door side attachment member 41. One end portion of the third link 71 is connected to a lower end portion of a connecting shaft 89 disposed through the third connecting hole 27. By this arrangement, the one end portion of the third link 71 is connected to the second housing side attachment member 21 such that the third link 71 is rotatable about an axis (third rotation axis) of the connecting shaft 89. The other end portion of the third link 71 is connected to a lower end portion of a connecting shaft (third connecting shaft) 90 disposed through a sixth connecting hole 46. By this arrangement, the other end portion of the third link 71 is connected to the second door side attachment member 41 such that the third link 71 is rotatable about an axis (sixth rotation axis, third rotation axis) of the connecting shaft 90.

The one end portion of the third link 71 is rotatably contacted with a lower surface of the first erect plate part 23 of the second housing side attachment member 21 via a washer 91. The other end portion of the third link 71 is contacted with a lower surface of the second support plate part 42*b* of the second door side attachment member 41 via a washer 91. Accordingly, the third link 71 is located below and spaced from the second link 61 by a distance equal to a distance between the under surface of the first erect plate part 23 and the upper surface of the second erect plate part 24 (=distance between the upper surface of the first support plate part 42*a* and the under surface of the second support plate part 42*b*) plus a thickness of the washer 91.

As mentioned above, a distance between axes of the first and fourth connecting holes 15, 34, a distance between axes of the second and fifth connecting holes 16 (26), 35 and a distance between axes of the third and sixth connecting holes 27, 36 are designed to be equal to one another. Accordingly, a distance between axes of the connecting shafts 82, 84 that are rotation axes of the one end portion and the other end portion of the first link 51, a distance between axes of the connecting shafts 85, 86 that are rotation axes of the one end portion of the second link 61 and axes of the connecting shafts 87, 88 that are rotation axes of the other end portion of the second link 61 and a distance between axes of the connecting shafts 89, 90 that are rotation axes of the one end portion and the other end portion of the third link 71 are equal to one another. As a result, a parallel link mechanism is constituted by the first and second housing side attachment members 11, 21, the first, second and third links 51, 61, 71 and the first and second door side attachment members 31, 41. Therefore, the first and second door side attachment members 31, 41 and the door B are rotated maintaining a constant attitude, in other words, moved in parallel.

As shown in FIGS. 3 to 8, rotational biasing mechanisms 100 are respectively disposed between the upper side portion of the other end portion of the second link 61 and the first door side attachment member 31 and between the lower side portion of the other end portion of the second link 61 and the second door side attachment member 41. The rotational biasing mechanism 100 disposed between the upper side portion of the second link 61 and the first door side attachment member 31 and the rotational biasing mechanism 100 disposed between the lower side portion of the second link 61 and the second door side attachment member 41 are vertically symmetrical to each other. Therefore, description will be made only for the rotational biasing mechanism 100 disposed between the upper side portion of the second link 61 and the first door side attachment member 31, and description will be omitted for the rotational biasing mechanism 100 disposed between the lower side portion of the second link 61 and the second door side attachment member 41.

The rotational biasing mechanism 100 has a cam member 101 fixedly attached to the second link 61, a movable shaft 102 disposed in the first door side attachment member 31 such that the movable shaft 102 can move toward and away from the cam member 101 and a biasing means 103 composed of a torsion coil spring, etc. that biases the movable shaft 102 toward the cam member 101.

Figure 6:
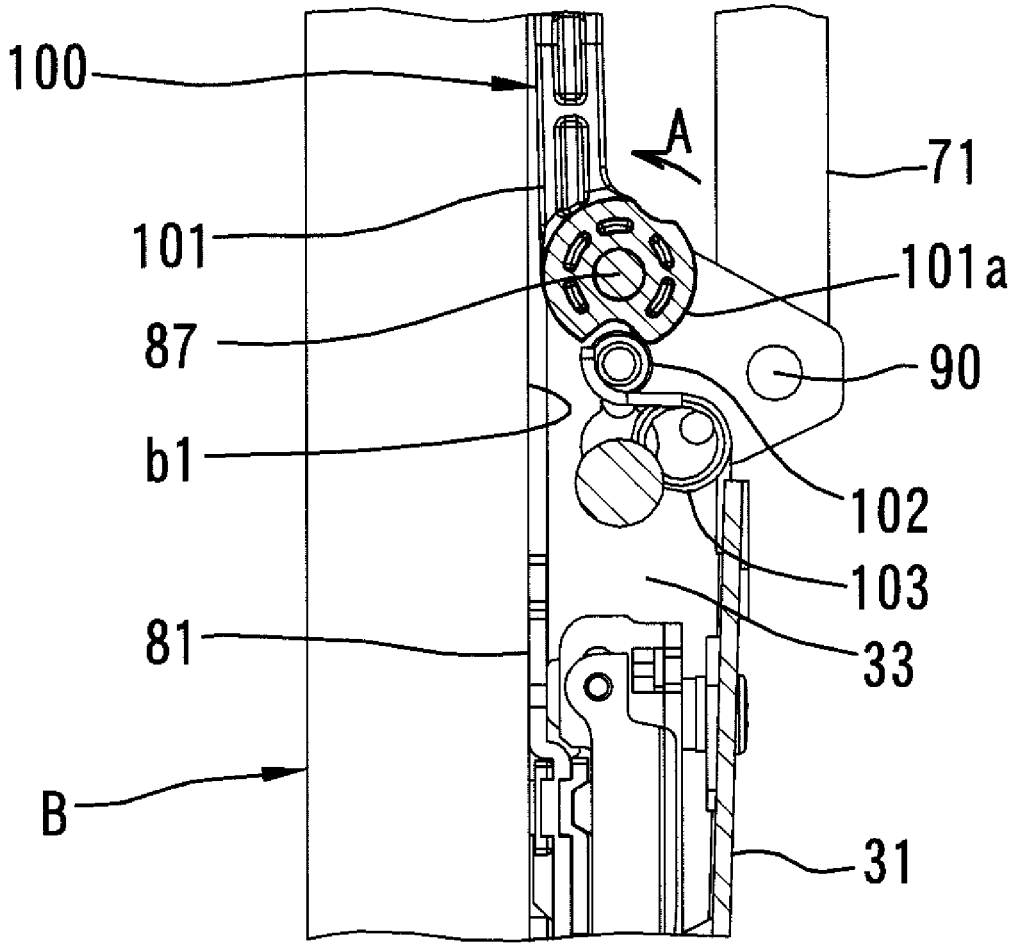
FIG. 6 is an enlarged view of a portion marked with circle X of FIG. 3.
Figure 7:
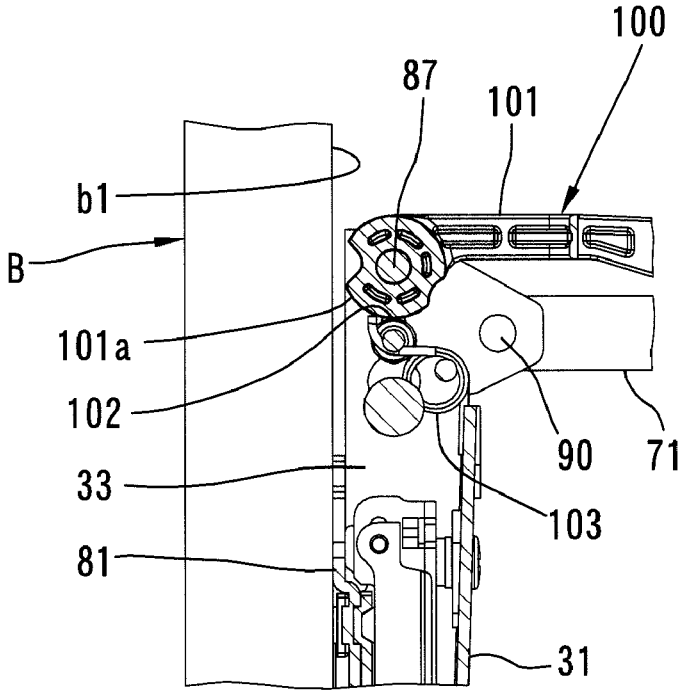
FIG. 7 is an enlarged view of a portion marked with circle X of FIG. 4.
Figure 8:
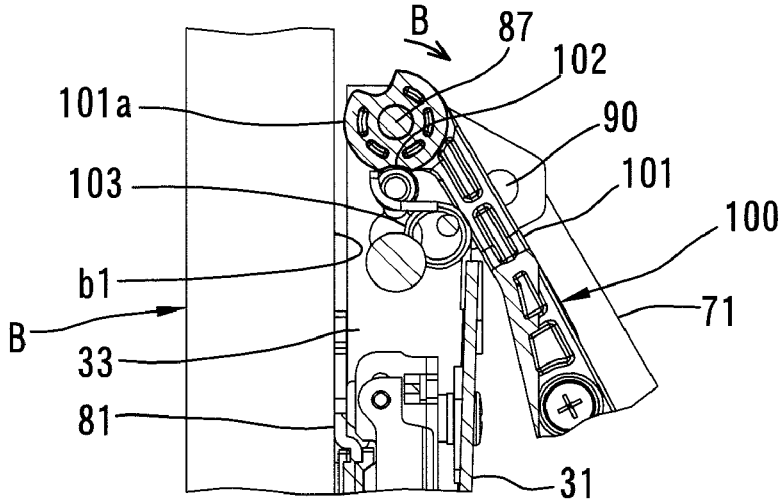
FIG. 8 is an enlarged view of a portion marked with circle X of FIG. 5.
Figure 9:
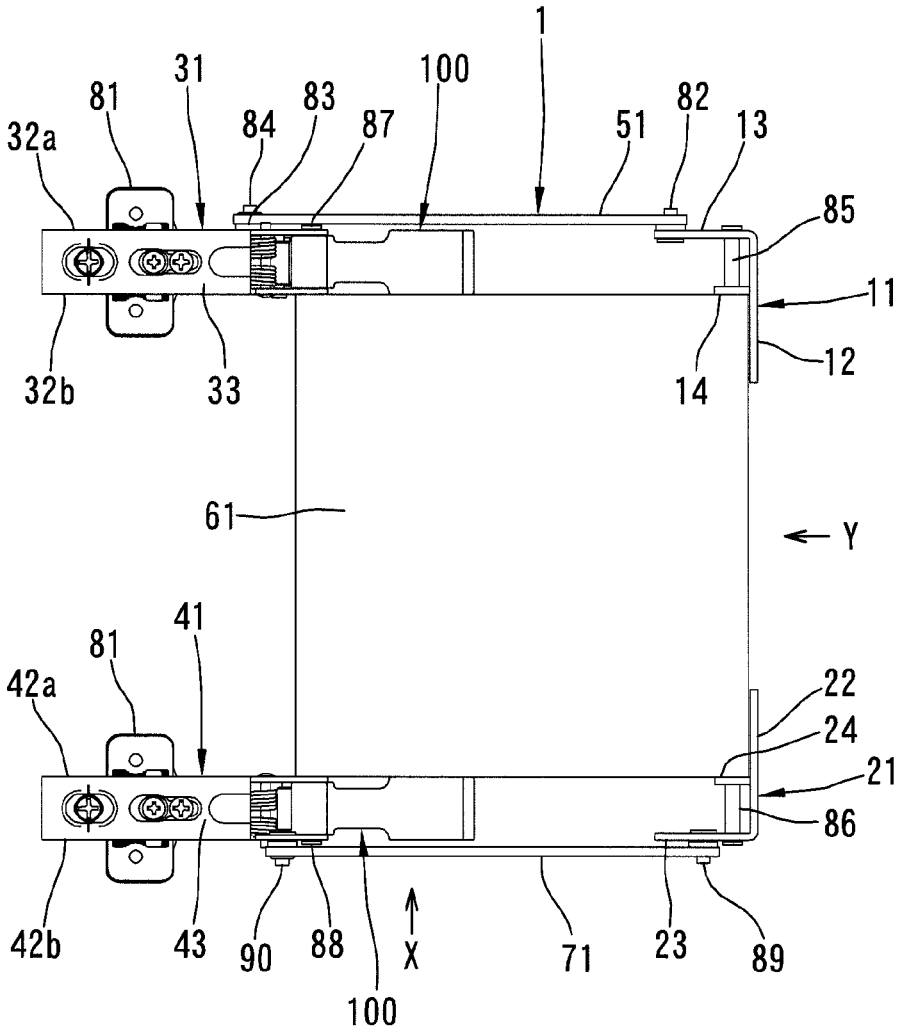
FIG. 9 is a front view of the first embodiment.
Figure 10:
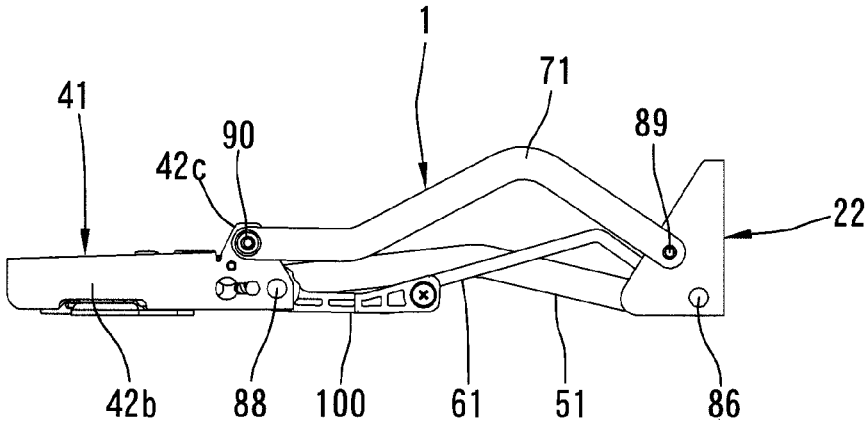
FIG. 10 is a view on arrow X of FIG. 9.
Figure 11:
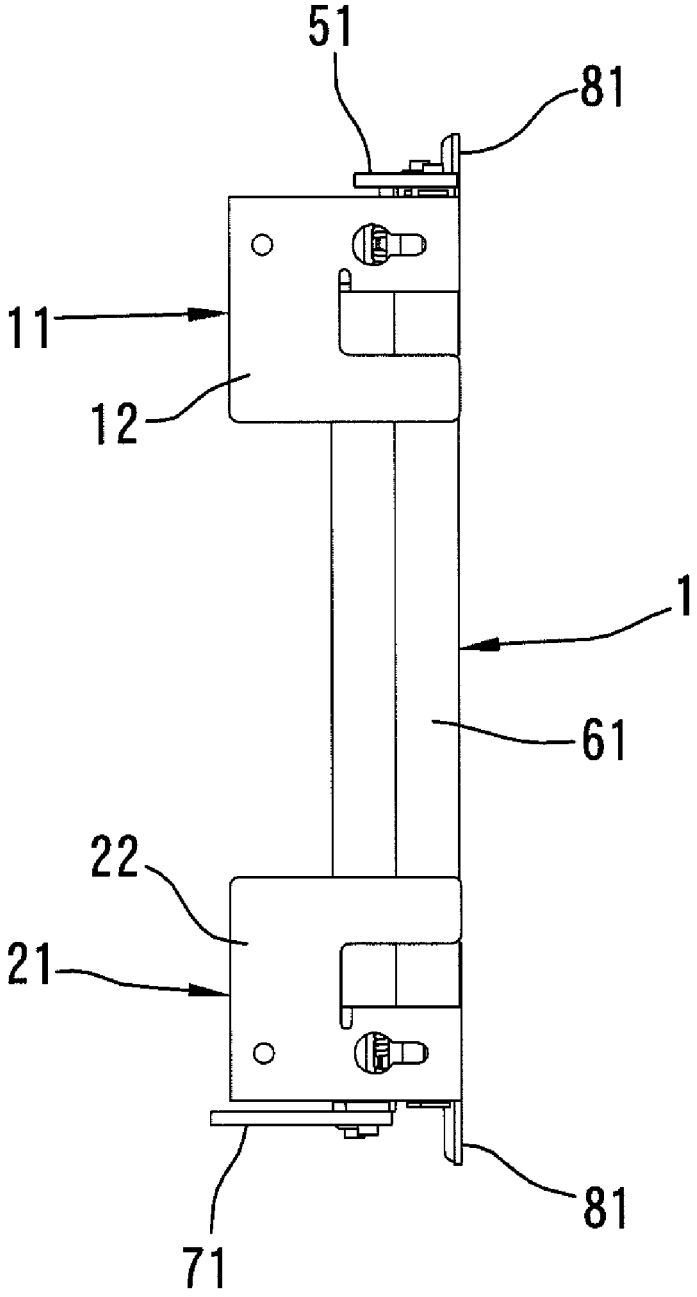
FIG. 11 is a view on arrow Y of FIG. 9.

A cam surface 101*a* is formed in an end portion of the cam member 101 nearer to the first door side attachment member 31. The movable shaft 102 is pressed against the cam surface 101*a* by the biasing means 103. As shown in FIG. 6, the cam surface 101*a* converts a biasing force of the biasing means 103 into a rotational biasing force in a direction of arrow A when the door B is located in a predetermined first angle range between the closed position and a position spaced from the closed position toward the open position by a predetermined angle. This rotational biasing force rotates the second link 61 in the direction of arrow A, rotates the door B to the closed position and maintains the door B at the closed position. As shown in FIG. 8, the cam surface 101*a* converts the biasing force of the biasing means 103 into a rotational biasing force in a direction of arrow B when the door B is located in a second angle range between an open position and a position spaced from the open position by a predetermined angle. This rotational biasing force rotates the second link 61 in the direction of arrow B, rotates the door B to the open position and maintains the door B at the open position. When the door B is located between the first angle range and the second angle range, the movable shaft 102 is contacted with an circular arc surface of the cam surface 101*a* centered on the axis of the connecting shaft 87 as shown in FIG. 7, and the door B is stopped at any location by a frictional resistance working between the cam surface 101*a* and the movable shaft 102.

In the hinge apparatus 1 having the features mentioned above, the first, second and third links 51, 61, 71 do not interfere with one another even when the first, second and third links 51, 61, 71 are rotated greatly since the first, second and third links 51, 61, 71 are spaced from one another in the direction of the rotational axes (the first to sixth rotational axes) thereof. In other words, the first, second and third links 51, 61, 71 can be rotated over a large angle without interfering with one another. Accordingly, a rotation angle (parallel translation distance) of the door B can be made large.

The first door side attachment member 31 can be used as the second door side attachment member 41 and the second door side attachment member 41 can be used as the first door side attachment member 31 since the fourth, fifth and sixth connecting holes 34, 35, 36; 44, 45, 46 are provided in both the first and second door side attachment members 31; 41. Particularly, in this embodiment, it is not necessary to manufacture the first and second door side attachment members 31, 41 as different components since the configuration and the dimensions of the first and second door side attachment members 31, 41 are the same. It is enough if either kind of the door side attachment members 31, 41 are manufactured. Therefore, the manufacturing cost of the hinge apparatus can be reduced.

Other embodiments of the hinge apparatus according to the present invention will be described next. Description will be made only of the features different from those of the above-mentioned embodiment. Same reference signs will be assigned to features common to those of the above-mentioned embodiment, and the description thereof will be omitted.

Figure 13:
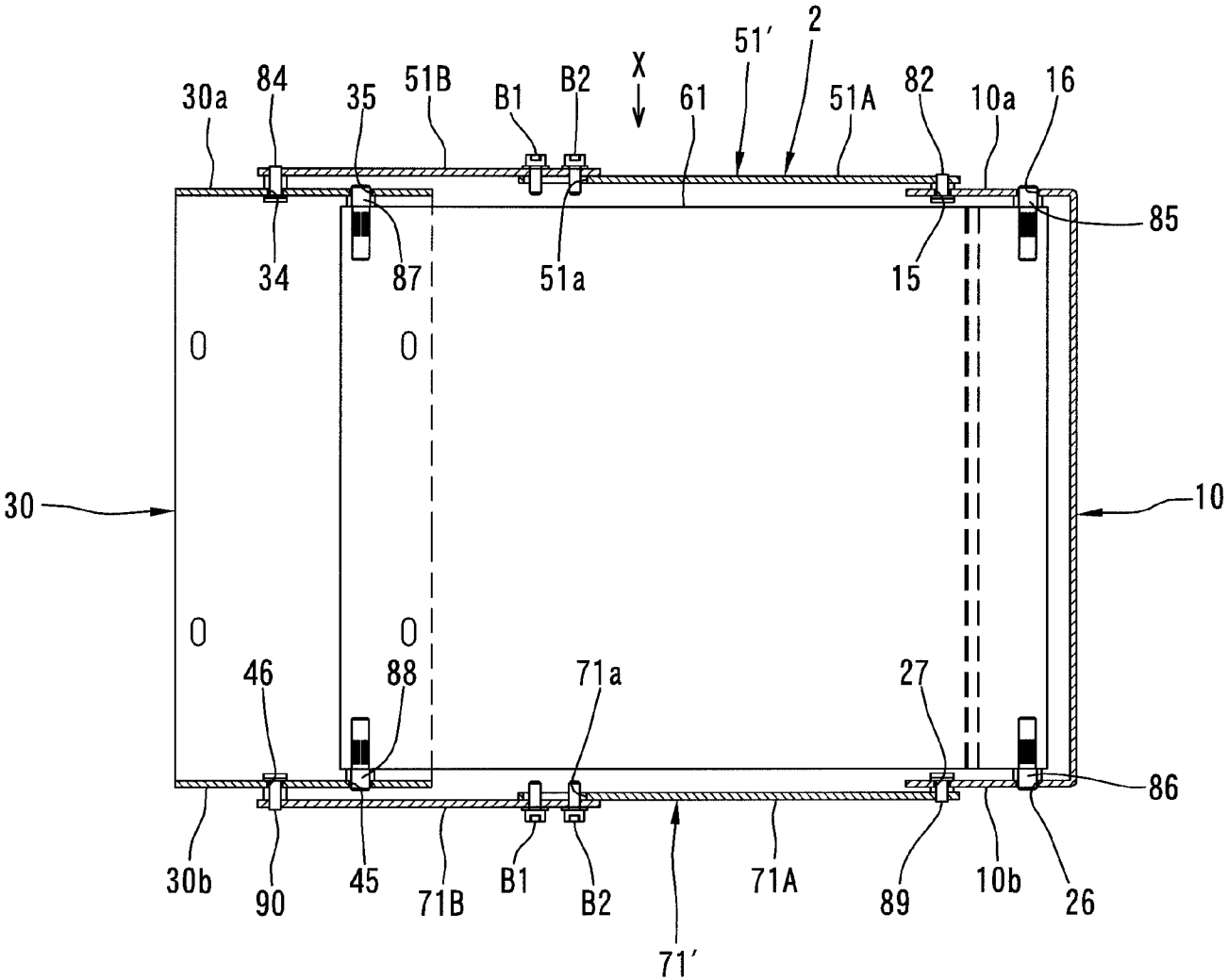
FIG. 13 is a front cross-sectional view of the second embodiment of the hinge apparatus according to the present invention.
Figure 14:
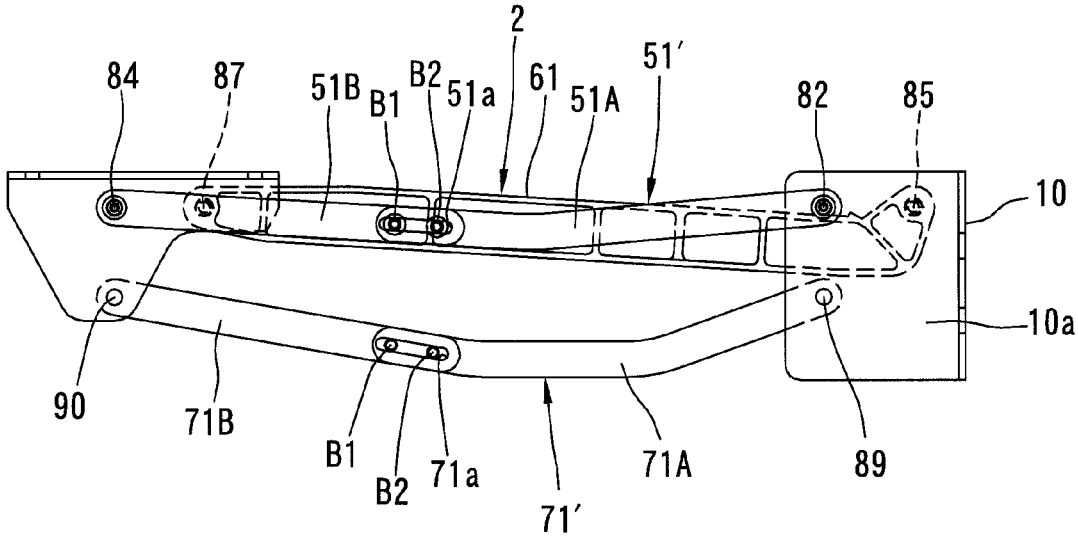
FIG. 14 is a view on arrow X of FIG. 13.

FIGS. 13 and 14 show the second embodiment of the present invention. In a hinge apparatus 2 of this embodiment, a single housing side attachment member 10 is used instead of the two (the first and second) housing side attachment members 11, 21, and a single door side attachment member 30 is used instead of the two (the first and second) door side attachment members 31, 41. Moreover, first and third links 51', 71' are used instead of the first and third links 51, 71.

The housing side attachment member 10 is integrally formed as a single piece and is fixed to the inner side surface a3 of the housing A. An upper plate part 10*a* and a lower plate part 10*b* are respectively disposed in an upper end portion and a lower end portion of the housing side attachment member 10. The upper plate part 10*a* and the lower plate part 10*b* are horizontally disposed, vertically spaced from each other and are arranged opposed to each other in the vertical direction. The first connecting hole 15 and the second connecting hole 16 are formed in the upper plate part 10*a*. The second connecting hole 26 and the third connecting hole 27 are formed in the lower plate part 10*b*.

The door side attachment member 30 is integrally formed as a single piece and is fixed to the rear surface b1 of the door B. An upper plate part 30*a* and a lower plate part 30*b* are respectively horizontally disposed in an upper end portion and a lower end portion of the door side attachment member 30. The upper plate part 30*a* and the lower plate part 30*b* are vertically spaced from each other and are arranged opposed to each other in the vertical direction. Moreover, the upper plate part 30*a* and the lower plate part 30*b* are respectively disposed at the same locations as the upper plate part 10*a* and a lower plate part 10*b* of the housing side attachment member 10 in the vertical direction. The fourth connecting hole 34 and the fifth connecting hole 35 are formed in the upper plate part 30*a*. The fifth connecting hole 45 and the sixth connecting hole 46 are formed in the lower plate part 30*b*.

The first link 51' has a housing side first link constituent 51A and a door side first link constituent 51B that are separate components. One end portion of the housing side first link constituent 51A is connected to the housing side attachment member 10 such that the housing side first link constituent 51A is rotatable about the axis (first rotation axis) of the connecting shaft 82 inserted in the first connecting hole 15. One end portion of the door side first link constituent 51B is connected to the door side attachment member 30 such that the door side first link constituent 51B is rotatable about the axis (fourth rotation axis, first rotation axis) of the connecting shaft 84 inserted in the fourth connecting hole 34. End portions of the housing side first link constituent 51A and the door side first link constituent 51B adjacent to each other are overlapped with each other in the direction of the rotation axes and are fixed with screws B1, B2. In this arrangement, a length between points where the connecting shafts 82, 84 are respectively inserted in the first link 51' can be adjusted to be the same as a distance between the first and fourth connecting holes 15, 34 by adjusting the length of the portions where the housing side first link constituent 51A and the door side first link constituent 51B are overlapped with each other. Such an adjustment can be performed by forming an elongated hole 51*a* in at least one of the housing side and the door side first link constituents 51A, 51B, the elongated hole 51*a* extending in a longer direction of the at least one of the housing side and the door side first link constituents 51A, 51B, adjusting the length of the overlapped portions and fixing the housing side first link constituent 51A and the door side first link constituent 51B by fastening the screws B1, B2 inserted in the elongated hole 51*a*.

The upper side portion of the one end portion of the second link 61 is connected to the housing side attachment member 10 such that the second link 61 is rotatable about the axis (second rotation axis) of the connecting shaft 85 inserted in the second connecting hole 16. The lower side portion of the one end portion of the second link 61 is connected to the housing side attachment member 10 such that the second link 61 is rotatable about the axis (second rotation axis) of the connecting shaft 86 inserted in the second connecting hole 26. The upper side portion of the other end portion of the second link 61 is connected to the door side attachment member 30 such that the second link 61 is rotatable about the axis (fifth rotation axis, second rotation axis) of the connecting shaft 87 inserted in the fifth connecting hole 35. The lower side portion of the other end portion of the second link 61 is connected to the door side attachment member 30 such that the second link 61 is rotatable about the axis (fifth rotation axis, second rotation axis) of the connecting shaft 88 inserted in the fifth connecting hole 45. Although the second link 61 is not provided with a rotational biasing mechanism, it may be provided with a rotational biasing mechanism.

The third link 71' has a housing side third link constituent 71A and a door side third link constituent 71B that are separate components. One end portion of the housing side third link constituent 71A is connected to the housing side attachment member 10 such that the housing side third link constituent 71A is rotatable about the axis (third rotation axis) of the connecting shaft 89 inserted in the third connecting hole 27. One end portion of the door side third link constituent 71B is connected to the door side attachment member 30 such that the door side third link constituent 71B is rotatable about the axis (sixth rotation axis, third rotation axis) of the connecting shaft 90 inserted in the sixth connecting hole 46. End portions of the housing side third link constituent 71A and the door side third link constituent 71B adjacent to each other are overlapped with each other in the direction of the rotation axes and are fixed with the screws B1, B2. In this arrangement, a length between points where the connecting shafts 89, 90 are respectively inserted in the third link 71' can be adjusted by an elongated hole 71*a* formed in at least one of the housing side third link constituent 71A and the door side third link constituents 71B and the screws B1, B2 inserted in the elongated hole 71*a* in a similar manner to the first link 51'.

In manufacturing the hinge apparatus 2 of this embodiment, it is not necessary to accurately provide the distance between the points of the first link 51' corresponding to the first and fourth rotation axes and the distance between the points of the third link 71' corresponding to the third and sixth rotation axes since the lengths of the first and third links 51', 71' can be adjusted. Therefore, the manufacturing cost of the first and third links 51', 71' can be reduced. Moreover, if the first and third links 51', 71' are attached to the housing side attachment member 10 and the door side attachment member 30 after the second link 61 is attached to the housing side attachment member 10 and the door side attachment member 30, the first, second and third links 51', 61, 71' can be easily attached to the housing side attachment member 10 and the door side attachment member 30 by properly adjusting the lengths of the first and third links 51', 71'.

Figure 15:
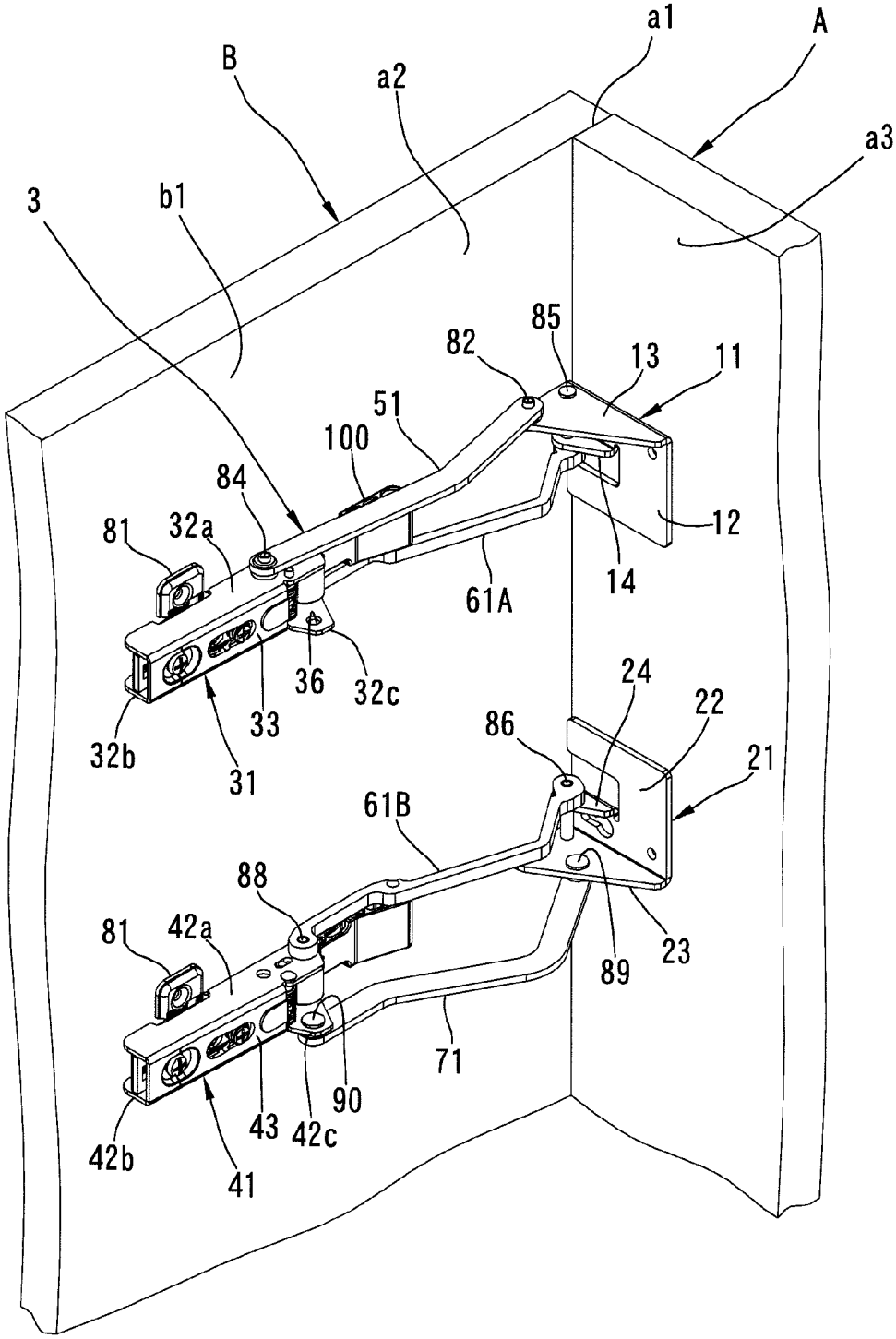
FIG. 15 is a perspective view of the third embodiment of the hinge apparatus according to the present invention with the hinge apparatus attached to the housing and the door.
Figure 16:
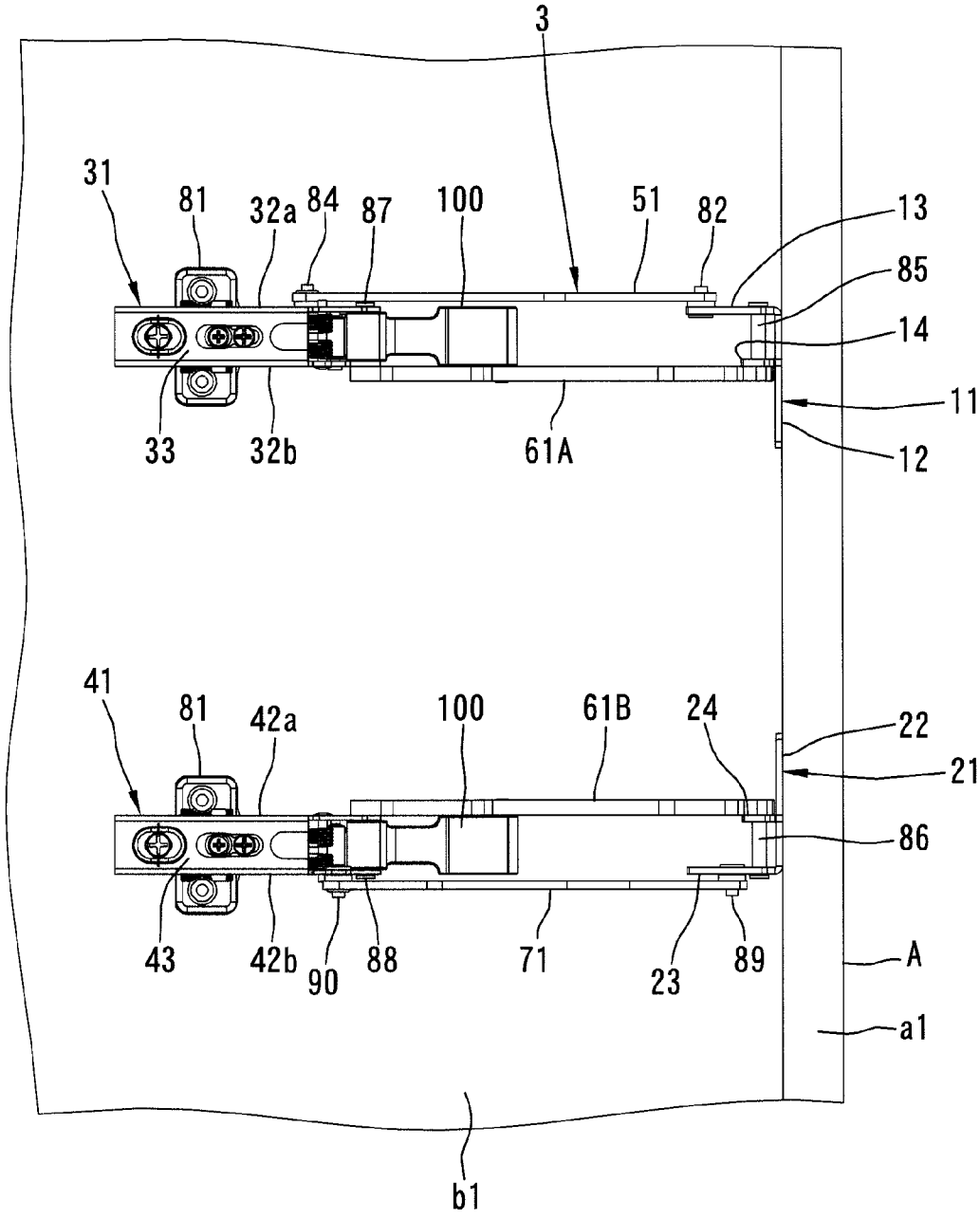
FIG. 16 is a front view of the third embodiment.

FIG. 15 and FIG. 16 show the third embodiment of the present invention. In a hinge apparatus 3 of this embodiment, two links (an upper second link (second link) 61A and a lower second link (second link) 61B) are used instead of the single second link 61. Thickness of the upper second link 61A and the lower second link 61B in a vertical direction is much smaller than a width of the second link 61 in the vertical direction. Accordingly, the upper second link 61A and the lower second link 61B are spaced from each other in the vertical direction (direction of the first to the sixth rotation axes). The upper second link 61A is spaced downwardly from the first link 51 and the lower second link 61B is spaced upwardly from the third link 71.

One end portion of the upper second link 61A is rotatably connected to the first housing side attachment member 11 via the connecting shaft 85. The other end portion of the upper second link 61A is rotatably connected to the first door side attachment member 31 via the connecting shaft 87. One end portion of the lower second link 61B is rotatably connected to the second housing side attachment member 21 via the connecting shaft 86. The other end portion of the lower second link 61B is rotatably connected to the second door side attachment member 41 via the connecting shaft 88.

Figure 17:
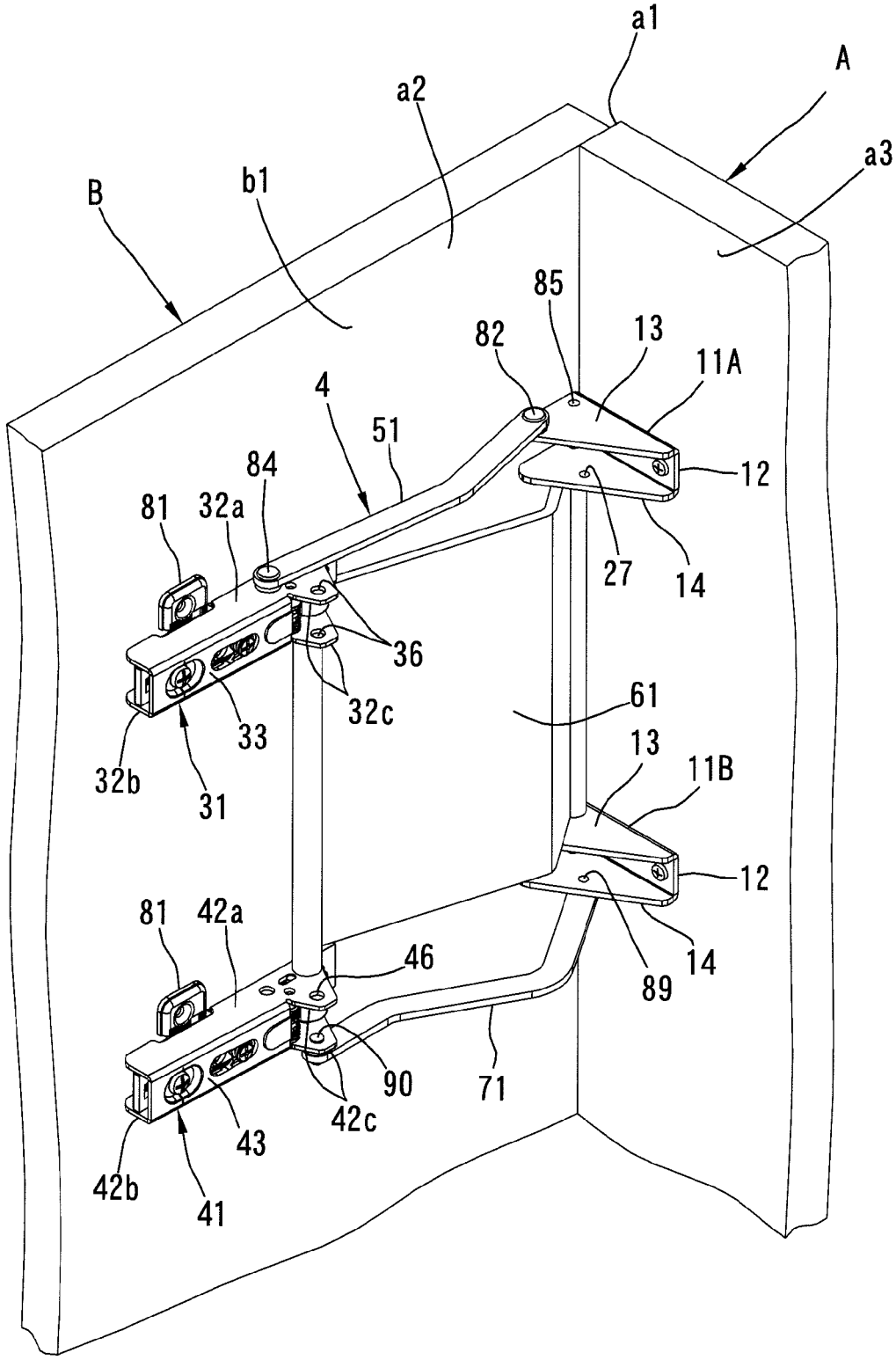
FIG. 17 is a perspective view of the fourth embodiment of the hinge apparatus according to the present invention with the hinge apparatus attached to the housing and the door.
Figure 18:
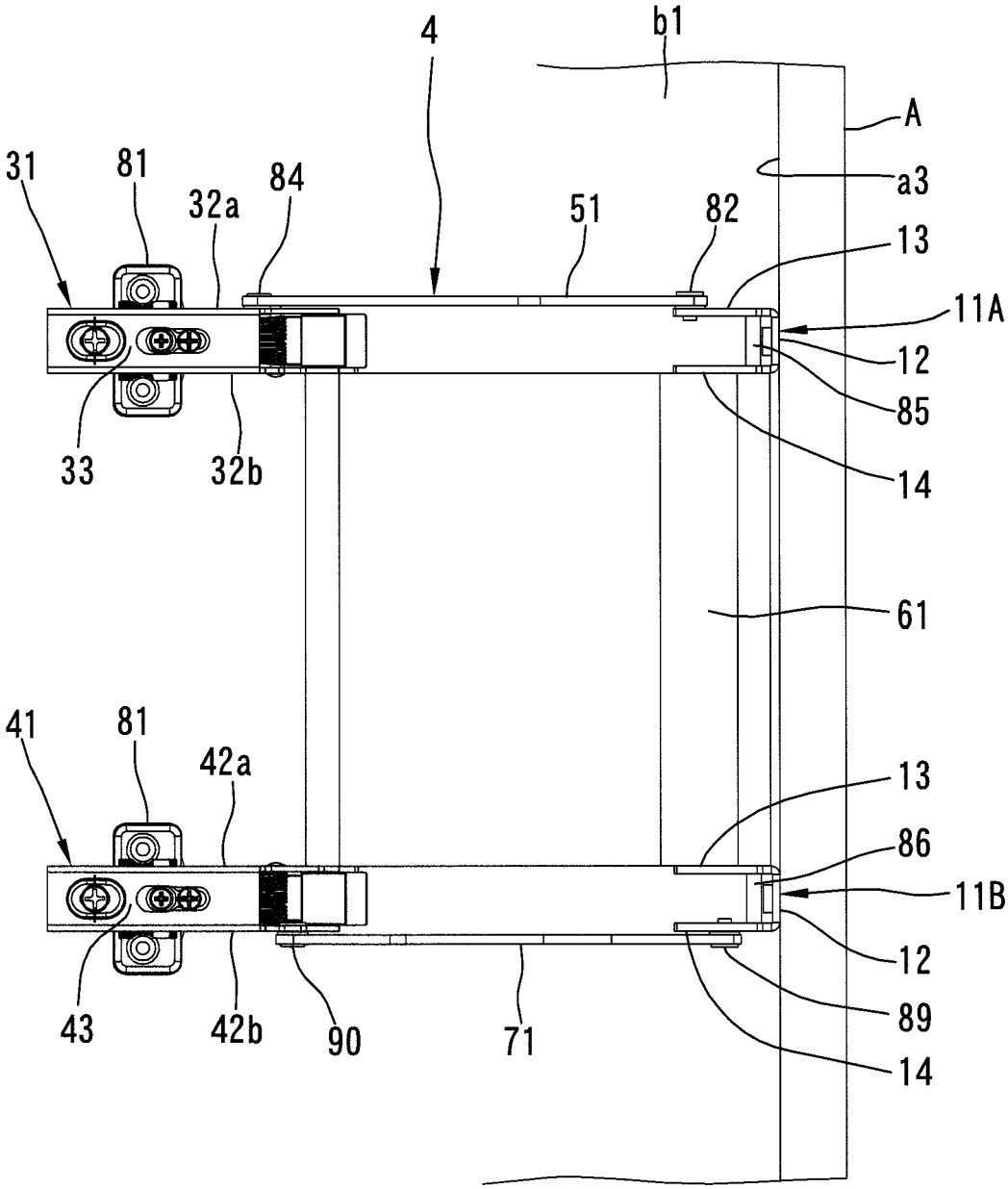
FIG. 18 is a front view of the fourth embodiment.
Figure 19:
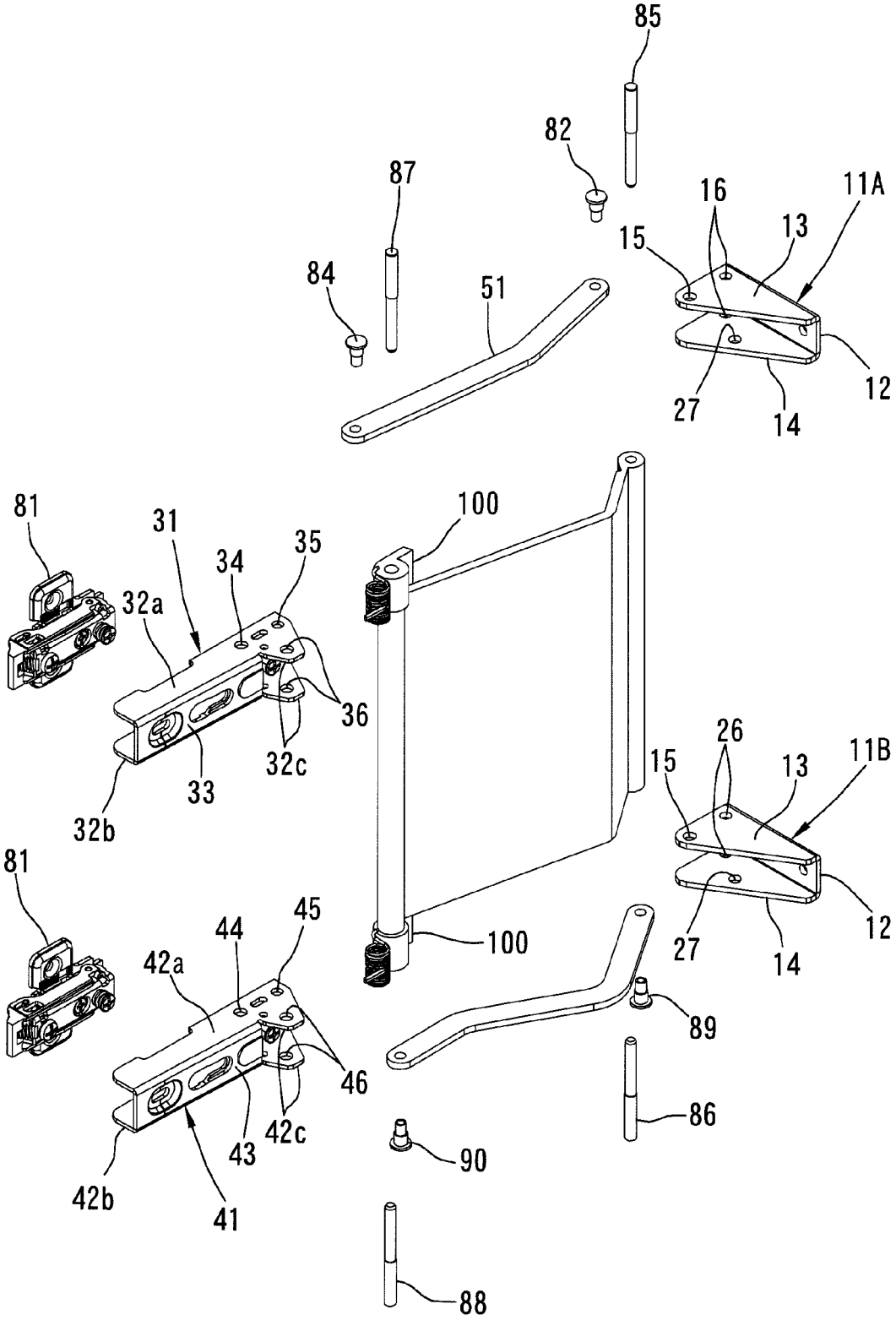
FIG. 19 is an exploded perspective view of the fourth embodiment.

FIG. 17 to FIG. 19 show the fourth embodiment of the present invention. In a hinge apparatus 4 of this embodiment, first and second housing side attachment members (housing side attachment members) 11A, 11B are used instead of the first and second housing side attachment members 11, 21. The first housing side attachment member 11A has the attachment plate part 12, the first erect plate part 13 and the second erect plate part 14. In this respect, the first housing side attachment member 11A is the same as the first housing side attachment member 11. However, in the first housing side attachment member 11A, the second erect plate part 14 is formed in the same configuration and the same dimensions as the first erect plate part 13. Moreover, the second erect plate part 14 has the third connecting hole 27 as well as the second connecting hole 16 formed therein. The second housing side attachment member 11B is formed in the same configuration and the same dimensions as the first housing side attachment member 11A. The second housing side attachment member 11B is different from the first housing side attachment member 11A only in that the second housing side attachment member 11B is located below the first housing side attachment member 11A by a predetermined distance and that the second housing side attachment member 11B has the second connecting hole 26. However, the second connecting hole 26 is the same as the second connecting hole 16. Therefore, the second housing side attachment member 11B is the same as the first housing side attachment member 11A.

One end portion of the first link 51 is rotatably connected to the housing side attachment member 11A located in the higher location via the connecting shaft 82. The upper side portion of the one end portion of the second link 61 is also rotatably connected to the housing side attachment member 11A via the connecting shaft 85. The lower side portion of the one end portion of the second link 61 is rotatably connected to the housing side attachment member 11B located in the lower location via the connecting shaft 86. The one end portion of the third link 71 is also rotatably connected to the housing side attachment member 11B via the connecting shaft 89.

In the hinge apparatus 4 of this embodiment, the fourth, fifth and sixth connecting holes 34, 35, 36 are formed in both of the first support plate part 32*a* and the second support plate part 32*b* of the first door side attachment member 31 and the fourth, fifth and sixth connecting holes 44, 45, 46 are formed in both of the first support plate part 42*a* and the second support plate part 42*b* of the second door side attachment member 41. Therefore, the first and second door side attachment members 31, 41 can be used regardless of the orientation thereof in the left-right direction.

In the hinge apparatus 4, either one of the two housing side attachment members 11A, 11B can be located higher or lower with respect to each other since the connecting holes 15, 16 (26), 27 for attaching the first to the third links 51, 61, 71 are formed both in the housing side attachment member 11A located in the higher location and in the housing side attachment member 11B located in the lower location. This precludes the occurrence of a mistake in arrangement. Particularly in this embodiment, since the two housing side attachment members 11A, 11B to be located in the higher or lower location are identical, it is not necessary to manufacture two kinds of (the first and second) housing side attachment members. Only one kind of the housing side attachment members 11A (11B) need to be manufactured. This reduces the manufacturing cost of the hinge apparatus 4. The housing side attachment members 11A, 11B to be located in the higher or lower location may be formed in different configurations as long as they have the connecting holes 15, 16 (26), 27.

Figure 20:
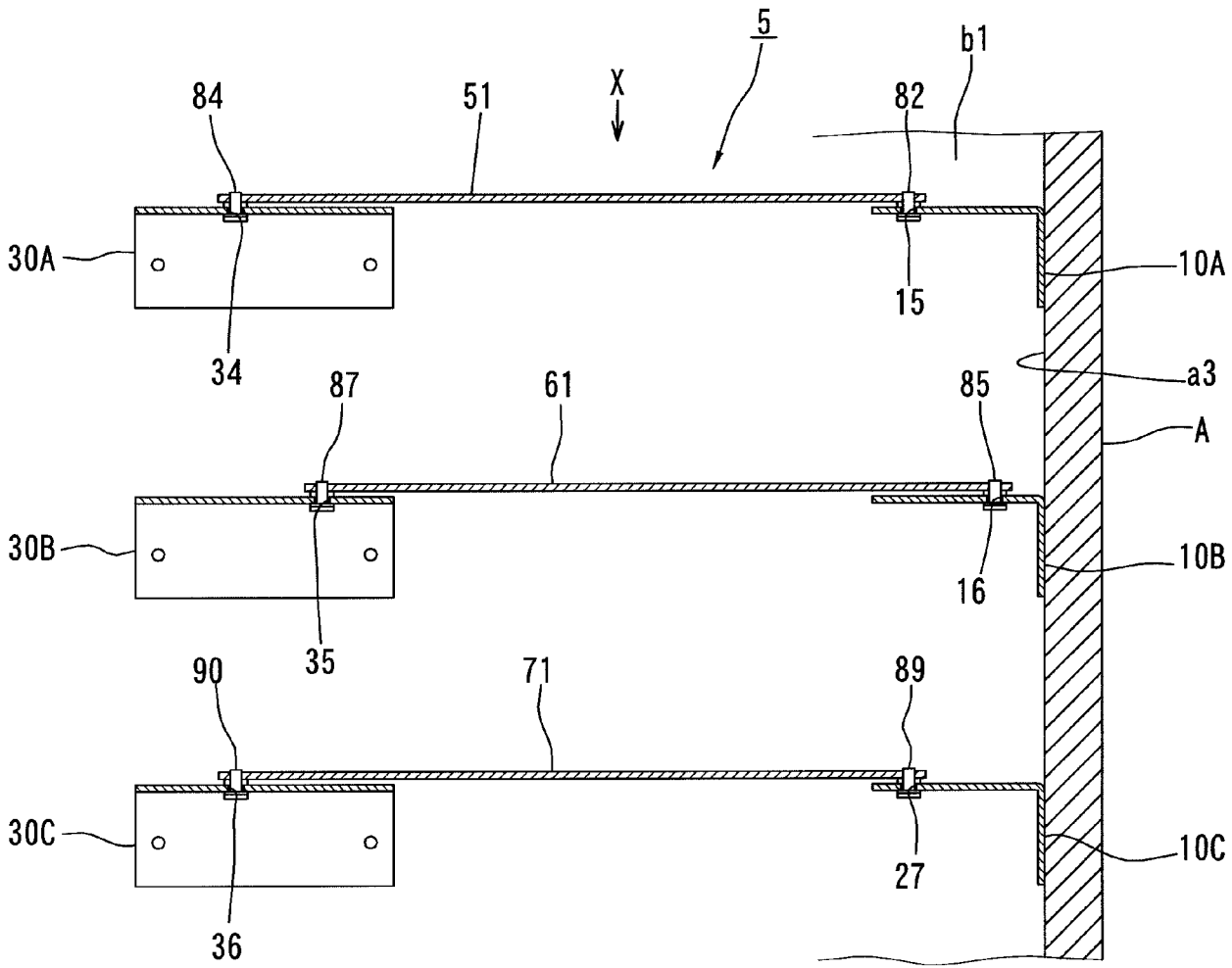
FIG. 20 is a front view of the fifth embodiment of the hinge apparatus according to the present invention with the hinge apparatus attached to the housing and the door.
Figure 21:
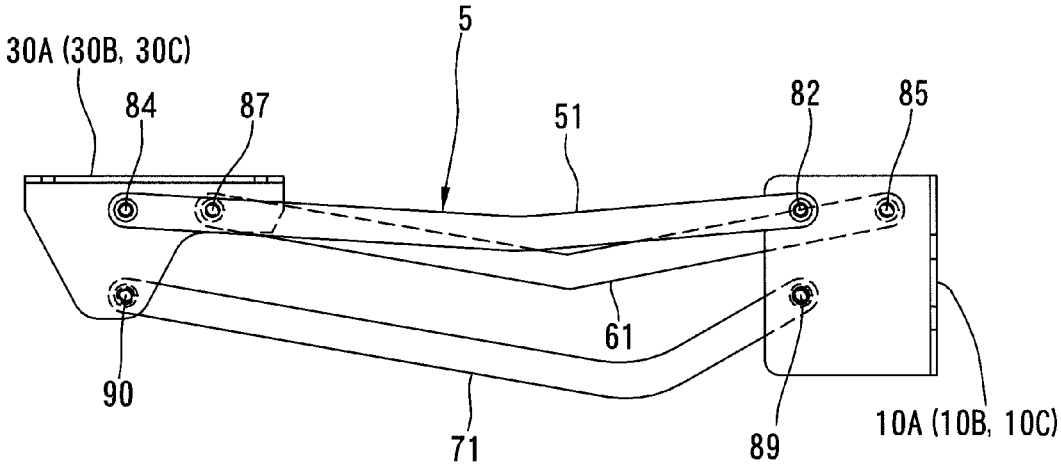
FIG. 21 is a view on arrow X of FIG. 20.

FIGS. 20 and 21 show the fifth embodiment of the present invention. In a hinge apparatus 5 of this embodiment, first, second and third housing side attachment members (housing side attachment members) 10A, 10B, 10C and first, second and third door side attachment members (door side attachment members) 30A, 30B, 30C are used. The first, second and third housing side attachment members 10A, 10B, 10C are vertically spaced from one another. The first, second and third door side attachment members 30A, 30B, 30C are also vertically spaced from one another. Moreover, the first, second and third door side attachment members 30A, 30B, 30C are located in the generally same location as the first, second and third housing side attachment members 10A, 10B, 10C in the vertical direction.

The first, second and third housing side attachment members 10A, 10B, 10C respectively have the first, second and third connecting holes 15, 16, 27 formed therein. The first, second and third door side attachment members 30A, 30B, 30C respectively have the fourth, fifth and sixth connecting holes 34, 35, 36 formed therein. The one end portion of the first link 51 is rotatably connected to the first housing side attachment member 10A via the connecting shaft 82 inserted in the first connecting hole 15. The other end portion of the first link 51 is rotatably connected to the first door side attachment member 30A via the connecting shaft 84 inserted in the fourth connecting hole 34. In the similar manner, the one end portion and the other end portion of the second link 61 are respectively rotatably connected to the second housing side attachment member 10B and the second door side attachment member 30B via the connecting shafts 85, 87, and the one end portion and the other end portion of the third link 71 are respectively rotatably connected to the third housing side attachment member 10C and the third door side attachment member 30C via the connecting shafts 89, 90.

Although particular embodiments of the invention have been described above, it will be understood that various modifications may be made without departing from the scope of the invention described herein.

For example, while the first and second housing side attachment members 11, 21 are attached to the housing A and the first and second door side attachment members 31, 41 are attached to the door B in the first, third and fourth embodiments described above, the first and second housing side attachment members 11, 21 may be used as the door side attachment members and the first and second door side attachment members 31, 41 may be used as the housing side attachment members. In other words, the first and second housing side attachment members 11, 21 may be attached to the door B and the first and second door side attachment members 31, 41 may be attached to the housing A.

While the second link 61 is provided in the first housing side attachment member 11 and the first door side attachment member 31 and the second link 61 is also provided in the second housing side attachment member 21 and the second door side attachment member 41 in the embodiment shown in FIGS. 15 and 16, one of the two second links 61, 61 may be omitted.

Moreover, while the first to the sixth connecting holes 15, 16, 26, 27, 34, 35, 36, 44, 45, 46 are formed as the first to the sixth connecting parts in the embodiments described above, shaft parts may be formed instead of these holes and the first to the third links 51, 51', 61, 61A, 61B, 71, 71' may be rotatably connected to the shaft parts.

INDUSTRIAL APPLICABILITY

The hinge apparatus according to the present invention may be used as a hinge apparatus for rotatably connecting a door to a housing such that the door maintains a constant attitude while being rotated, and particularly as a hinge apparatus that allows a door to be rotated over a large angle.

REFERENCE SIGNS LIST

1 hinge apparatus
2 hinge apparatus
3 hinge apparatus
4 hinge apparatus
5 hinge apparatus
10 housing side attachment member
10A first housing side attachment member (housing side attachment member)
10B second housing side attachment member (housing side attachment member)
10C third housing side attachment member (housing side attachment member)
11 first housing side attachment member (housing side attachment member)
15 first connecting hole (first connecting part)
16 second connecting hole (second connecting part)
21 second housing side attachment member (housing side attachment member)
26 second connecting hole (second connecting part)
27 third connecting hole (third connecting part)
30 door side attachment member
30A first door side attachment member (door side attachment member)
30B second door side attachment member (door side attachment member)
30C third door side attachment member (door side attachment member)
31 first door side attachment member (door side attachment member, attachment member for hinge apparatus)
32*a* first support plate part
32*b* second support plate part
32*c* projecting portion
34 fourth connecting hole (fourth connecting part, first connecting part)
35 fifth connecting hole (fifth connecting part, second connecting part)
36 sixth connecting hole (sixth connecting part, third connecting part)
41 second door side attachment member (door side attachment member, attachment member for hinge apparatus)
42*a* first support plate part
42*b* second support plate part
42*c* projecting portion
44 fourth connecting hole (fourth connecting part, first connecting part)
45 fifth connecting hole (fifth connecting part, second connecting part)
46 sixth connecting hole (sixth connecting part, third connecting part)
51 first link
51' first link
61 second link
61A upper second link (second link)
61B lower second link (second link)
71 third link
71' third link
81 base
82 connecting shaft
84 connecting shaft (first connecting shaft)
85 connecting shaft
86 connecting shaft
87 connecting shaft (second connecting shaft)
88 connecting shaft
89 connecting shaft
90 connecting shaft (third connecting shaft)

The invention claimed is:

1. A hinge apparatus, comprising:

a housing side attachment member;

a door side attachment member;

first, second and third links, one end portions of the first, second and third links connected to the housing side attachment member such that the first, second and third links are respectively rotatable about first, second and third rotation axes parallel to one another, the other end portions of the first, second and third links connected to the door side attachment member such that the first, second and third links are respectively rotatable about fourth, fifth and sixth rotation axes parallel to the first, second and third rotation axes; and a parallel link mechanism constituted by the housing side attachment member, the door side attachment member, and the first, second and third links, the first, second and third links being arranged in that order, spaced from one another in a direction of the rotation axes thereof, the housing side attachment member having first and second housing side attachment members formed as separate components and arranged to be spaced from each other in the direction of the first, second and third rotation axes, the one end portion of the first link connected to the first housing side attachment member such that the first link is rotatable about the first rotation axis, a one side portion of the one end portion of the second link in the direction of the rotation axis connected to the first housing side attachment member such that the second link is rotatable about the second rotation axis, the other side portion of the one end portion of the second link in the direction of the rotation axis connected to the second housing side attachment member such that the second link is rotatable about the second rotation axis, the one end portion of the third link connected to the second housing side attachment member such that the third link is rotatable about the third rotation axis, the door side attachment member having first and second door side attachment members formed as separate components and arranged to be spaced from each other in the direction of the fourth, fifth and sixth rotation axes, the other end portion of the first link connected to the first door side attachment member such that the first link is rotatable about the fourth rotation axis, a one side portion of the other end portion of the second link in the direction of the rotation axis connected to the first door side attachment member such that the second link is rotatable about the fourth rotation axis, the other side portion of the other end portion of the second link in the direction of the rotation axis connected to the second door side attachment member such that the second link is rotatable about the fifth rotation axis, and the other end portion of the third link connected to the second door side attachment member such that the third link is rotatable about the sixth rotation axis.

2. A hinge apparatus comprising:

a housing side attachment member;

a door side attachment member;

first, second and third links, one end portions of the first, second and third links connected to the housing side attachment member such that the first, second and third links are respectively rotatable about first, second and third rotation axes parallel to one another, the other end portions of the first, second and third links connected to the door side attachment member such that the first, second and third links are respectively rotatable about fourth, fifth and sixth rotation axes parallel to the first, second and third rotation axes; and a parallel link mechanism constituted by the housing side attachment member, the door side attachment member, and the first, second and third links, the first, second and third links being arranged in that order, spaced from one another in a direction of the rotation axes thereof, the housing side attachment member having first and second housing side attachment members formed as separate components and arranged to be spaced from each other in the direction of the first, second and third rotation axes, each of the first and second housing side attachment member provided with first, second and third connecting parts that can be respectively connected to the one end portions of the first, second and third links such that the first, second and third links are respectively rotatable about the first, second and third rotation axes, one end portions of the first and second links respectively connected to the first and second connecting parts of the first housing side attachment member such that the first and second links are respectively rotatable about the first and second rotation axes, one end portions of the second and third links respectively connected to the second and third connecting parts of the second housing side attachment member such that the second and third links are respectively rotatable about the second and third rotation axes, the door side attachment member having first and second door side attachment members formed as separate components and arranged to be spaced from each other in the direction of the fourth, fifth and sixth rotation axes, each of the first and second door side attachment member provided with fourth, fifth and sixth connecting parts that can be respectively connected to the other end portions of the first, second and third links such that the first, second and third links are respectively rotatable about the fourth, fifth and sixth rotation axes, the other end portions of the first and second links respectively connected to the fourth and fifth connecting parts of the first door side attachment member such that the first and second links are respectively rotatable about the fourth and fifth rotation axes, and the other end portions of the second and third links respectively connected to the fifth and sixth connecting parts of the second door side attachment member such that the second and third links are respectively rotatable about the fifth and sixth rotation axes.

3. An attachment member for hinge apparatus comprising:

first and second support plate parts opposed to each other;

a connecting plate part connecting one side portions of the first and second support plate parts;

a first connecting part formed in one end portion of the first support plate part;

a second connecting part formed in one end portion of at least one of the first support plate part and the second support plate part; and a third connecting part formed in the one end portion of the second support plate part, one end portions of first, second and third links respectively connected to the first connecting part, the second connecting part and the third connecting part such that the first, second and third links are respectively rotatable about first, second and third rotation axes extending parallel to one another, the first, second and third rotation axes extending in a direction in which the first and second support plate parts are opposed to each other, the first, second and third connecting parts being spaced from one another in the direction of the first, second and third rotation axes.

4. An attachment member for hinge apparatus according to claim 3 wherein:

a projecting portion is formed in the one end portion of the second support plate part, the projecting portion projecting in a direction orthogonal to a direction connecting the first and second connecting parts;

the third connecting part is formed in the projecting portion; and the third connecting part is spaced from the first and second connecting parts in the direction orthogonal to the direction connecting the first and second connecting parts.

5. An attachment member for hinge apparatus according to claim 4 wherein:

the first connecting part is a first connecting hole formed in the first support plate part and extending along the first rotation axis;

the second connecting part is a second connecting hole formed in at least one of the first support plate part and the second plate part and extending along the second rotation axis;

the third connecting part is a third connecting hole formed in the second support plate part and extending along the third rotation axis.

6. An attachment member for hinge apparatus according to claim 5 wherein the first, second and third connecting holes are formed through the first and second support plate parts.

* * * * *